US012600553B1

(12) United States Patent
Hoffman et al.

(10) Patent No.: US 12,600,553 B1
(45) Date of Patent: Apr. 14, 2026

(54) TOOLLESS CRATE ASSEMBLY WITH INTERCHANGEABLE CARTRIDGE

(71) Applicant: Larson Packaging Company, LLC, Milpitas, CA (US)

(72) Inventors: Mark A. Hoffman, Park City, UT (US); Hector Rafael Monrroy Gonzalez, Fremont, CA (US); David Matthew Skurla, San Jose, CA (US)

(73) Assignee: LARSON PACKAGING COMPANY, LLC, Milpitas, CA (US)

( * ) Notice: Subject to any disclaimer, the term of this patent is extended or adjusted under 35 U.S.C. 154(b) by 0 days.

(21) Appl. No.: 19/031,975

(22) Filed: Jan. 18, 2025

(51) Int. Cl.

| | |
|---|---|
| ***B65D 81/05*** | (2006.01) |
| ***B65D 81/107*** | (2006.01) |
| ***B65D 85/30*** | (2006.01) |
| ***B65D 85/64*** | (2006.01) |
| ***B65D 85/68*** | (2006.01) |
| ***B65D 88/12*** | (2006.01) |
| ***B65D 88/54*** | (2006.01) |

(52) U.S. Cl.
CPC ..... *B65D 81/058* (2013.01); *B65D 81/107* (2013.01); *B65D 85/30* (2013.01); *B65D 85/64* (2013.01); *B65D 85/68* (2013.01); *B65D 88/127* (2013.01); *B65D 88/542* (2013.01); *B65D 2585/649* (2013.01)

(58) Field of Classification Search
CPC .... B65D 81/05; B65D 81/058; B65D 81/107; B65D 85/30; B65D 85/64; B65D 85/68; B65D 88/127; B65D 88/542; B65D 2585/649
USPC ..... 206/305, 320, 521, 523
See application file for complete search history.

(56) References Cited

U.S. PATENT DOCUMENTS

| | | | | |
|---|---|---|---|---|
| 2,771,987 | A * | 11/1956 | Kennedy | B65D 19/44 206/521 |
| 9,635,778 | B2 * | 4/2017 | Tsai | H05K 7/1488 |
| 9,676,517 | B2 * | 6/2017 | Jiang | B65D 19/42 |
| 10,850,757 | B1 * | 12/2020 | Curlee | B62B 3/003 |
| 11,124,358 | B2 * | 9/2021 | Wu | B65D 88/542 |
| 11,167,908 | B2 * | 11/2021 | Moshe | B65D 19/44 |
| 11,276,435 | B2 * | 3/2022 | Chen | B65D 81/057 |
| 11,388,836 | B2 * | 7/2022 | Curlee | H05K 7/1495 |

* cited by examiner

*Primary Examiner* — Bryon P Gehman
(74) *Attorney, Agent, or Firm* — Adibi IP Group, PC; Amir V. Adibi; Andrew C. Palmer

(57) ABSTRACT

A crate assembly includes a crate having a base and an interchangeable cartridge supported by the base. The interchangeable cartridge is insertable and removable from the base of the crate. The interchangeable cartridge includes a cartridge base and a well. The well is formed by a floater base, side rails, a back board, and a front board. Energy damping components are selected to support a desired load and are disposed between the cartridge base and the floater base thereby providing cushioning to a load carried in the crate. Brace brackets attach to ends of the side rails. After loading a server rack, openings on the front board slide over end bolts of the brace brackets thereby providing toolless securement of the load within the well. Worn cartridges are replaced with new cartridges thereby extending crate life and cartridges are customizable depending on application to support different load dimensions or weights.

16 Claims, 28 Drawing Sheets

PERSPECTIVE VIEW OF SERVER RACK CRATE

PERSPECTIVE VIEW OF SERVER RACK CRATE

FRONT VIEW OF SERVER RACK CRATE

PERSPECTIVE VIEW OF INTERCHANGEABLE CARTRIDGE

ANOTHER PERSPECTIVE VIEW OF INTERCHANGEABLE CARTRIDGE

FRONT VIEW OF INTERCHANGEABLE CARTRIDGE

REAR VIEW OF INTERCHANGEABLE CARTRIDGE

SIDE VIEW OF INTERCHANGEABLE CARTRIDGE

ANOTHER SIDE VIEW OF INTERCHANGEABLE CARTRIDGE

TOP VIEW OF INTERCHANGEABLE CARTRIDGE

BOTTOM VIEW OF INTERCHANGEABLE CARTRIDGE

PERSPECTIVE VIEW OF CRATE ASSEMBLY

INTERIOR OF CRATE WITH ENERGY DAMPENING COMPONENTS

SECURING ENERGY DAMPENING COMPONENTS TO CRATE INTERIOR

SECURING ENERGY DAMPENING COMPONENTS TO CRATE INTERIOR

LOADING SERVER RACK ONTO CARTRIDGE

SERVER RACK LOADED ON CARTRIDGE
(BEFORE SECURING FRONT BOARD)

SECURING ENERGY DAMPENING COMPONENTS TO CRATE INTERIOR
(AFTER SECURING FRONT BOARD)

SECURING ENERGY DAMPENING COMPONENTS TO CRATE INTERIOR

SECURING ENERGY DAMPENING COMPONENTS
TO CRATE INTERIOR

PERSPECTIVE VIEW OF BRACE BRACKET

BRACE BRACKET ATTACHED TO SIDE RAIL

BRACE BRACKET ATTACHED TO DIMENSIONAL LUMBER

EXPLODED VIEW OF CARTRIDGE SHOWING BRACE BRACKETS ATTACHED TO SIDE RAILS

SIDE VIEW OF BRACE BRACKET

FRONT VIEW OF BRACE BRACKET

TOP-DOWN VIEW OF BRACE BRACKET

USING AN INTERCHANGEABLE CARTRIDGE TO SECURE A LOAD ON A SERVER RACK CRATE

PROVIDING REPLACEMENT INTERCHANGEABLE CARTRIDGES AFTER USAGE

TOP VIEW OF INTERCHANGEABLE CARTRIDGE (ANOTHER EMBODIMENT)

SIDE VIEW OF INTERCHANGEABLE CARTRIDGE (ANOTHER EMBODIMENT)

TOOLLESS CRATE ASSEMBLY WITH INTERCHANGEABLE CARTRIDGE

TECHNICAL FIELD

The present invention relates generally to shipping and transportation, and more specifically, to securely packaging and transporting equipment.

BACKGROUND INFORMATION

In the complex world of cloud computing and data center infrastructure, the safe and efficient transportation of high-value server racks is crucial. As technology continues to advance, the demand for robust and reliable shipping solutions for sensitive electronic equipment has grown significantly. Server racks, which house critical components of data centers and cloud computing facilities, require specialized protection during transit to prevent damage from impacts, vibrations, and environmental factors.

The logistics of transporting server racks presents unique challenges due to the size, weight, and sensitivity of the equipment. Shipping containers must be designed to withstand the rigors of various transportation methods, including truck, rail, and air freight, while maintaining a consistent level of protection throughout the journey.

SUMMARY

A crate assembly includes a crate having a base and an interchangeable cartridge supported by the base. The interchangeable cartridge is insertable and removable from the base of the crate. The interchangeable cartridge includes a cartridge base and a well. The well is formed by a cartridge floater base, cartridge side rails, a cartridge back board, and a cartridge front board. Energy damping components selected to support a desired load are disposed between the cartridge base and the cartridge floater base thereby providing cushioning to a load carried in the crate. The crate assembly is customized to support loads of various sizes and dimensions.

The interchangeable cartridge is customizable depending on application to provide a cushioning system for different configurations or weights of loads, such as server racks, storage devices, networking components, computing-related devices, or other sensitive equipment. The interchangeable cartridge is configured to have a well that matches dimensions of a load to be carried. In addition, the interchangeable cartridge includes energy damping components that provide shock absorption and vibration damping functionality. The shock and vibration absorption components are disposed between the cartridge base and the cartridge floater base.

The energy damping components are selected to dampen shock and vibration during transport and ensure the load is transported safely in the well provided by the interchangeable cartridge within the crate assembly. The shock and vibration absorption components are placed throughout the crate and interchangeable cartridge at strategic locations that maximize shock absorption characteristics while minimizing material usage that increases costs and complexity of the crate assembly.

In accordance with at least one novel aspect, the crate assembly is simple to assemble and disassemble without any specialized tools or equipment. This ease of assembly compared to conventional crate systems is partly achieved via novel brace brackets included with the crate assembly. The novel brace bracket is designed to attach to dimensional lumber, such as 2×4, 3×4, 4×4, or other sizes, to form a well with a toolless open front (and/or back) with secure fastening. In one example, brace brackets are used to mount the front board onto the side rails of the interchangeable cartridge. Each brace bracket is affixed to a front end of a cartridge side rail. Each of the brace brackets has an end bolt that extends from a front surface of the respective brace bracket. The cartridge front board has holes that align and fit onto the end bolts of the brace brackets. The front board is toollessly attachable to the side rails via end bolts of the brace brackets and secured via wing nuts and washers.

In accordance with another novel aspect, the novel interchangeable cartridge extends the life of the crate. After the interchangeable cartridge is worn, the interchangeable cartridge is replaced and swapped with a new interchangeable cartridge instead of needing to replace the entire crate. Wear and tear is a common cause of retiring or decommissioning crates. Wear is often greatest at the base of crate assemblies which support the majority of the load. Replacing an interchangeable cartridge instead of an entire crate assembly increases the effective lifespan of other crate assembly components. In addition, replacing the interchangeable cartridge instead of the entire crate assembly decreases shipping costs and reduces environmental impact caused by waste.

Further details and embodiments and methods are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
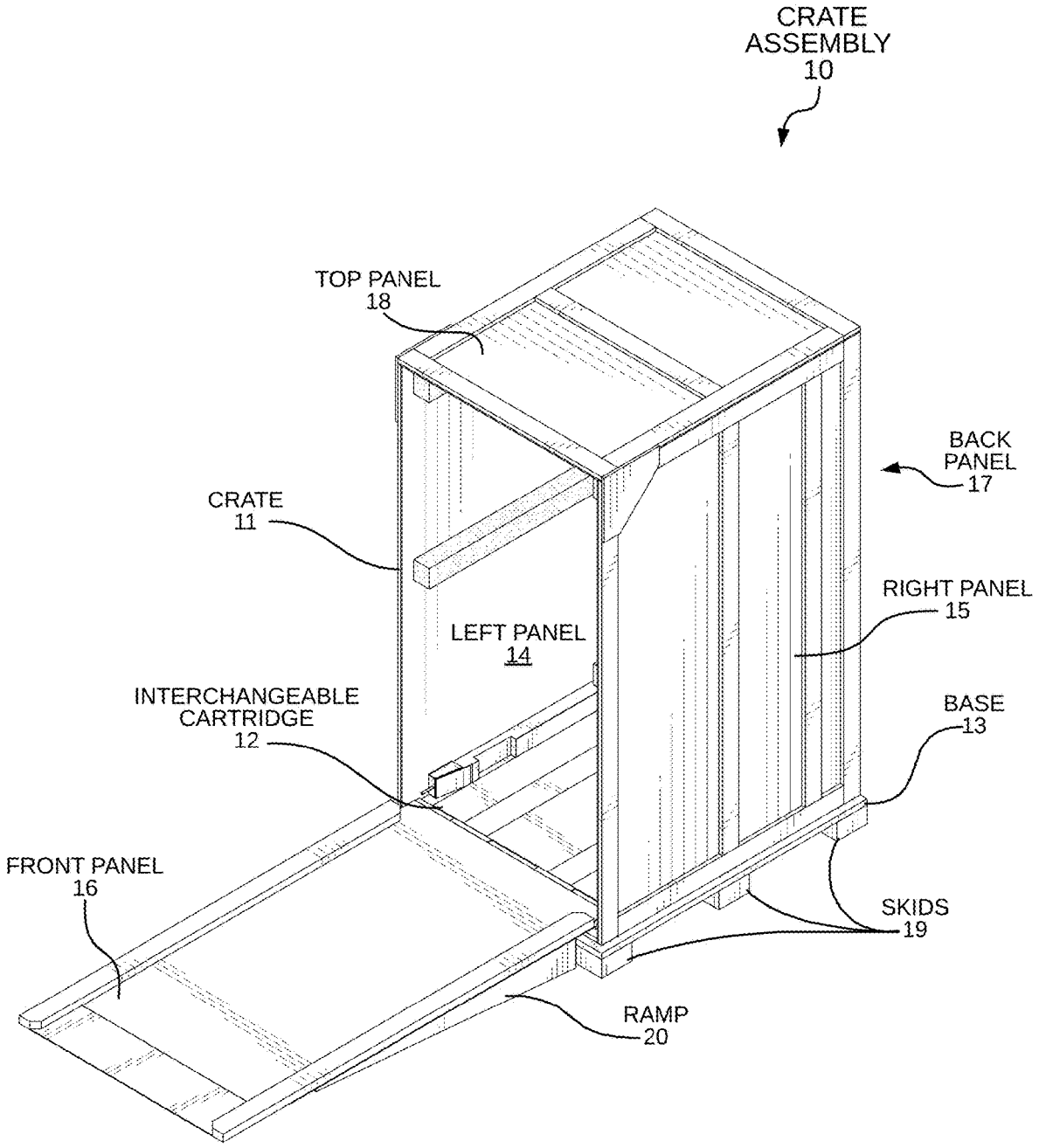
FIG. 1 is a diagram of a perspective view of a crate assembly for transporting server racks.

FIG. 1 is a diagram of a crate assembly 10 in accordance with one embodiment. The crate assembly 10 includes a crate 11 and an interchangeable cartridge 12. The crate 11 comprises a base 13, a left panel 14, a right panel 15, a front panel 16, a back panel 17, and a top panel 18. The base 13 of the crate 11 is supported on skids 19. The front panel 16 includes a ramp 20 that provides a sloped surface 21 for moving a load to be transported into the crate 10. The crate 10 includes one or more energy damping components disposed throughout interior surfaces of the crate 10. In some embodiments, energy damping components refers specifically to shock absorption and vibration damping components. Reference numeral 22 identifies one of the shock absorption and vibration damping components.

Figure 2:
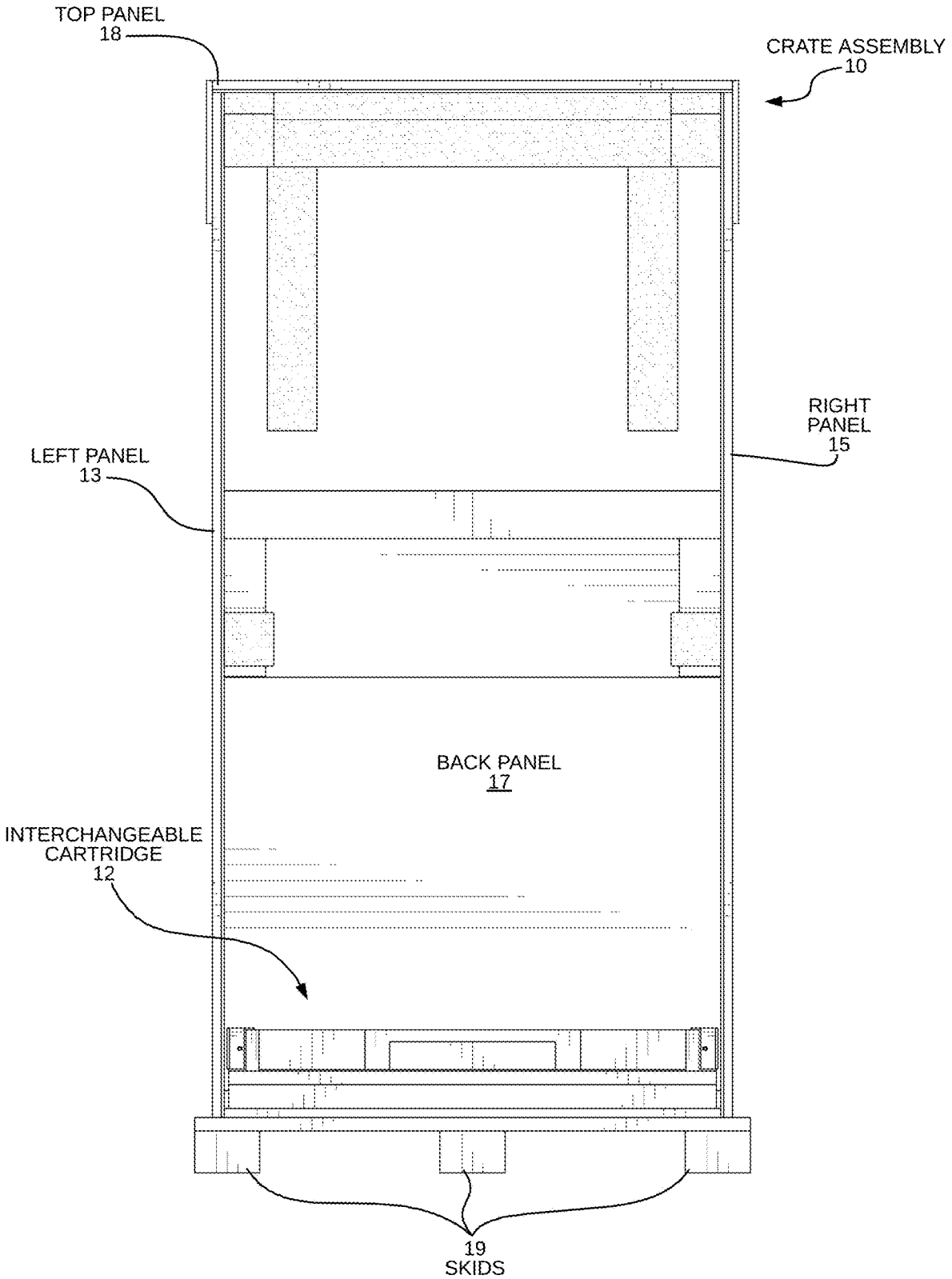
FIG. 2 is a diagram of a front orthogonal view of the crate assembly.

FIG. 2 is a diagram showing a front orthogonal view of the crate assembly 10. The crate assembly 10 includes a crate frame 11 formed by several panels arranged to create an enclosure. The interchangeable cartridge 12 is positioned within the crate frame 11, providing protective cushioning for the contents. The interchangeable cartridge 12 is replaceable, allowing the crate assembly 10 to be reused for multiple shipments or repurposed for different loads of varying weight, dimension, or configurations.

The crate assembly 10 is designed to support multiple shipments past the point when interchangeable cartridge 12 is replaced with a new interchangeable cartridge. The amount of shipments supported by the interchangeable cartridge 12 depends on the size and weight of the load, shipment distance, and other characteristics that affect wear of the interchangeable cartridge 12. In addition, a crate can be reused or repurposed by swapping out the interchangeable cartridge 12. For example, the interchangeable cartridge 12 configured for one type of load is swappable out for another interchangeable cartridge configured for another type of load having different weight, dimensions, or configurations.

The crate 11 is configured to carry sensitive equipment, such as servers, storage devices, networking components, and other computing related devices. In one embodiment, the crate 11 is a server rack crate that carries only servers having storage and networking components and no other types of loads. In another embodiment, the crate 11 is a computing equipment crate that carries only computing equipment and no other type of loads. In one embodiment, the load is loaded directly onto the interchangeable cartridge 12 without any intermediate structure between the load and the interchangeable cartridge 12.

The crate frame 11 comprises a base panel 13 that provides bottom support for the assembly. A left panel 14 and a right panel 15 form the side walls of the crate frame 11. In one embodiment, the left panel 14 and right panel 15 are made of wood, engineered wood, or plywood. In another embodiment, the left panel 14 and right panel 15 are made of reinforced plastic.

A front panel 16 is included in the crate assembly 10, which can be opened for access to the interior. In one embodiment, the front panel 16 is hinged. In another embodiment, the front panel 16 is completely removable.

A back panel 17 encloses the rear of the crate assembly 10. In one embodiment, the back panel 17 is fixed. In another embodiment, the back panel 17 is removable for rear access.

A top panel 18 forms the upper surface of the crate assembly 10. In one embodiment, the top panel 18 is flat. In another embodiment, the top panel 18 is slightly curved for improved water runoff.

The crate assembly 10 rests on support skids 19, which are attached to the base panel 13. In one embodiment, the support skids 19 are made of wood. In another embodiment, the support skids 19 are made of high-density plastic.

A loading ramp 20 extends from the front of the crate assembly 10, facilitating the loading and unloading of server racks. In one embodiment, the loading ramp 20 is permanently attached. In another embodiment, the loading ramp 20 is detachable for storage when not in use.

The overall structure of the crate assembly 10 creates a robust shipping container designed for protecting and transporting server rack equipment. The replaceable interchangeable cartridge 12 allows for extended use of the crate assembly 10, reducing the need for frequent replacement of the entire unit.

Figure 3:
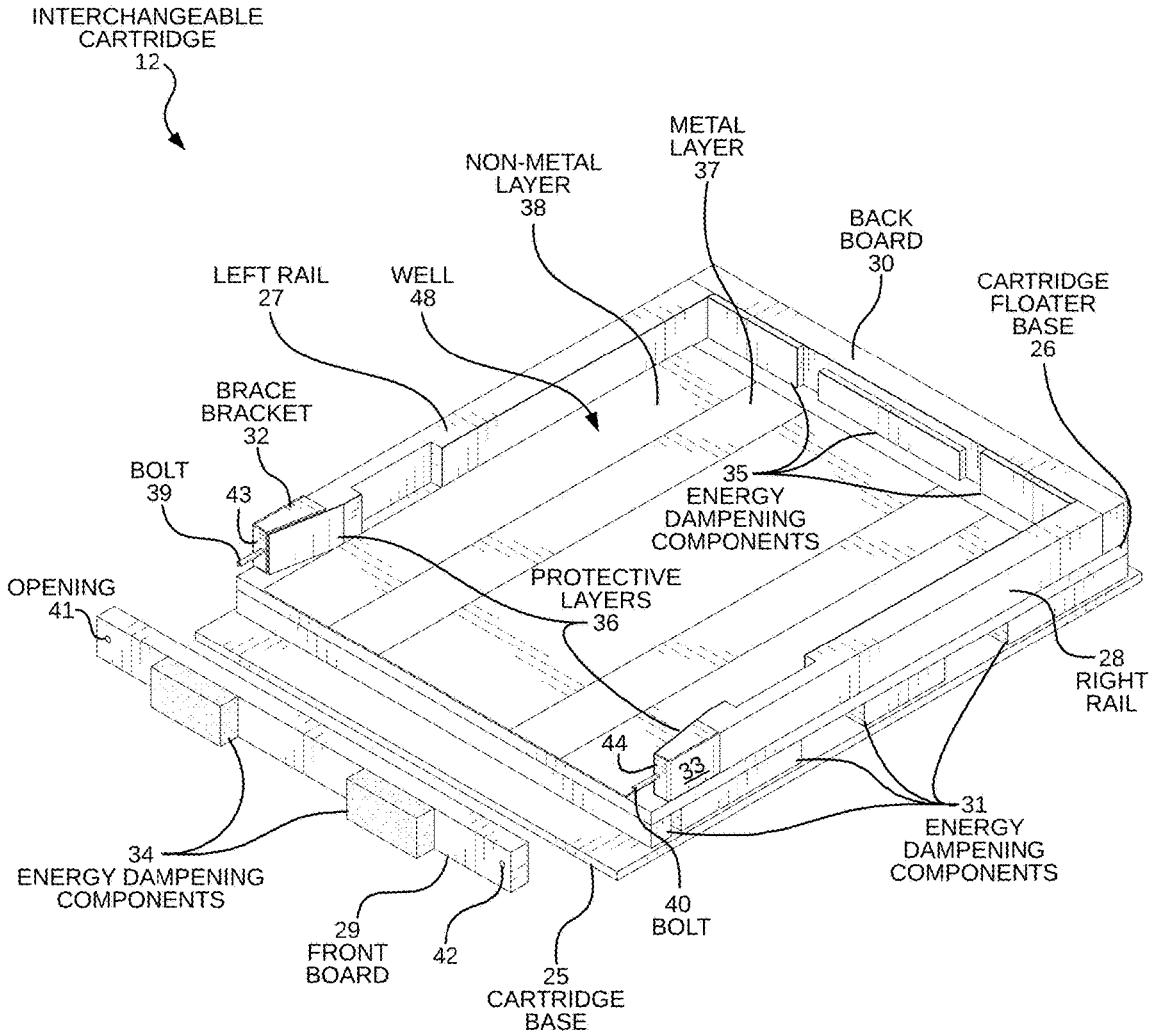
FIG. 3 is a diagram of a perspective view of an interchangeable cartridge assembly for a shipping crate.

FIG. 3 is a diagram of a perspective view of the interchangeable cartridge 12. The interchangeable cartridge 12 includes a cartridge base 25, a cartridge floater base 26, a left rail 27, a right rail 28, a front board 29, a back board 30, energy damping components 31, and toolless brace brackets 32 and 33. The front board 29 attaches via the brace brackets 32 and 33.

The energy damping components 31 are disposed between the cartridge base 25 and cartridge floater base 26. In one embodiment, the energy damping components 31 are the only structures disposed between the cartridge base 25 and cartridge floater base 26 such that the cartridge floater base 26 rests entirely on cushioning structures and no other non-cushioning structure is between the cartridge base 25 and cartridge floater base 26. In this embodiment, the energy damping components 31 include multiple energy damping parts. In other embodiments, the energy damping components 31 are one unitary energy damping component.

The front board 29 includes one or more energy damping components 34. The back board 30 includes one or more energy damping components 35 disposed throughout an interior surface of the back board 30. The left rail 27 and the right rail 28 include protective layers 36 to minimize damage to loads during loading onto the interchangeable cartridge 12. Cartridge floater base 26, front board 29, back board 30, and side rails 27 and 28 together create a well 48. A server rack or other load to be transported rests within well 48 during transit.

In one embodiment, cartridge floater base 26 includes a metal layer 37 and non-metal layer 38. Metal layer 37 creates a smooth, durable surface for a server rack to roll or slide on without damaging the cartridge base or the crate assembly. In one embodiment, the metal layer 37 is aluminum and the non-metal layer 38 is high-impact plastic. In another embodiment, the metal layer 37 is stainless steel and the non-metal layer 38 is reinforced fiberglass, wood, or engineered wood.

Each of the brace brackets 32 and 33 includes bolts 39 and 40, respectively. Bolt 39 extends from front surface 43 of brace bracket 32 and bolt 40 extends from front surface 44 of brace bracket 33. The front board 29 has openings 41 and 42 that engage the bolts 39 and 40 on the brace brackets 32 and 33. In one embodiment, a plurality of wing nuts 53 and 54 are used to secure front board 29 to bolts 39 and 40. In another embodiment, brace brackets 32 and 33 are not present, and bolts 39 and 40 are directly mounted to side rails 27 and 28.

Figure 4:
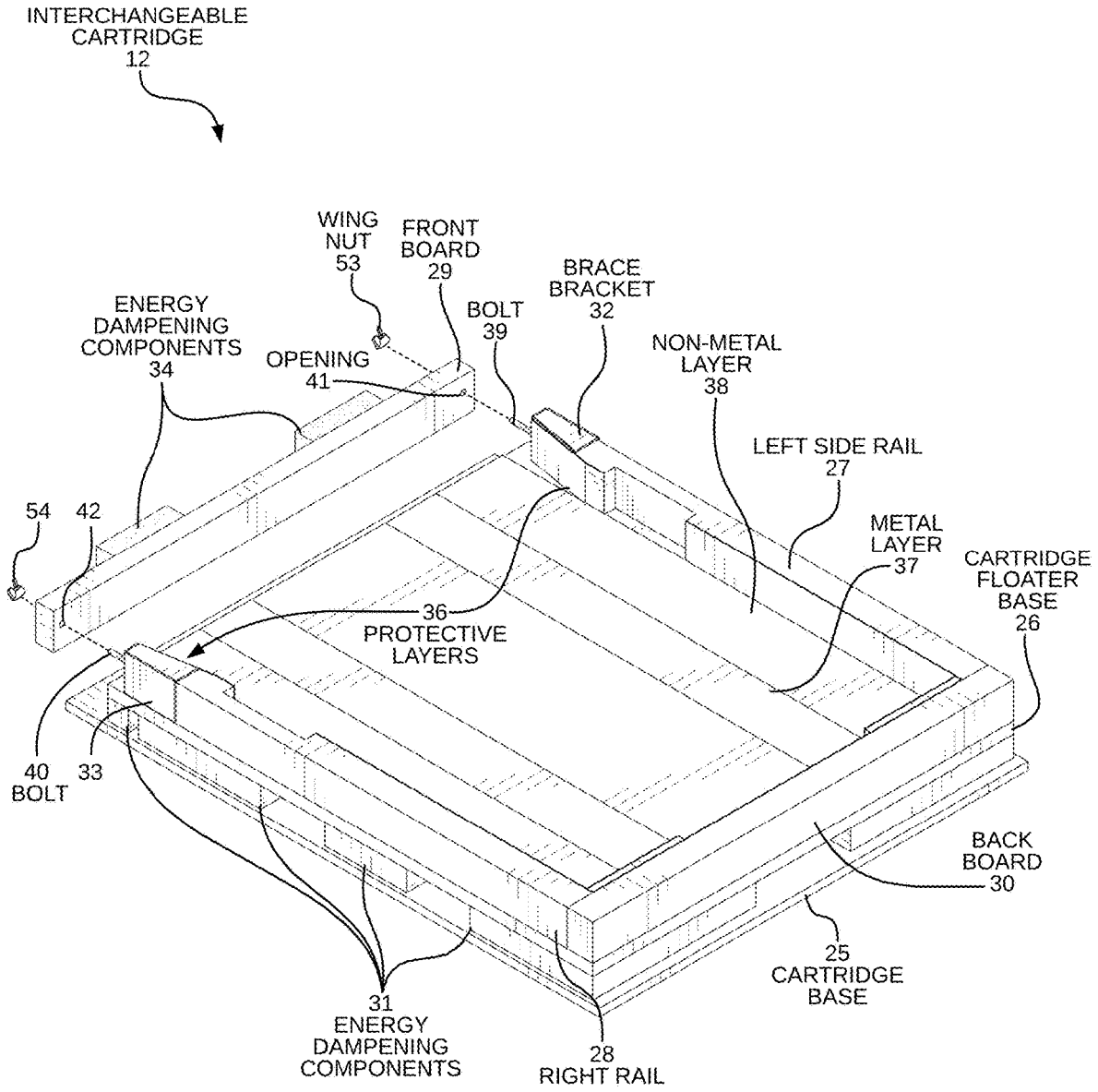
FIG. 4 is a diagram of another perspective view of the interchangeable cartridge assembly.

FIG. 4 is a diagram showing another perspective view of the interchangeable cartridge assembly. The interchangeable cartridge assembly includes a cartridge base 25 and a cartridge floater base 26 that work together to provide structural support. In one embodiment, the cartridge base 25 is formed from wood, engineered wood, or plywood. In another embodiment, the cartridge base 25 is made of high-density polyethylene.

The assembly is bounded by a left rail 27, a right rail 28, and a back board 30 which form the perimeter framework. In one embodiment, the rails are made of wood or engineered wood. In another embodiment, the rails are made of aluminum. In yet another embodiment, the rails are made of steel.

The assembly incorporates multiple energy damping components 31, 34, and 35 positioned at strategic locations throughout the structure to maximize absorption characteristics while reducing material usage. In one embodiment, the energy damping components 31, 34, and 35 are made of foam. The foam is any suitable foam material that provides isotropic impact performance, ensuring consistent protection from all directions. In one example, the foam is expanded polyethylene (EPE) foam. In another example, the foam is expanded polypropylene (EPP) beaded foam. In yet another example, the foam is polyurethane (PU) foam. In still other embodiments, energy damping components are each made from different shock absorbing capable materials.

Protective layers 36 are integrated into the design, providing additional protection. In one embodiment, protective layers 36 are made of felt. The structure includes bolt connections, specifically bolt 39 and bolt 40, which secure various components together. In one embodiment, the bolts are stainless steel. In another embodiment, the bolts are high-strength aluminum alloy.

The perspective views in FIG. 3 and FIG. 4 show how these components are arranged in a three-dimensional space, with the cartridge base 25 serving as the foundation for the assembly. The energy damping components 31, 34, and 35 are distributed throughout the structure to provide comprehensive protection. The rails 27 and 28, front board 29, and back board 30 create a frame that contains and supports the internal components while the protective layers 36, along with metal 37 and non-metal 38 layers provide additional protection.

Figure 5:
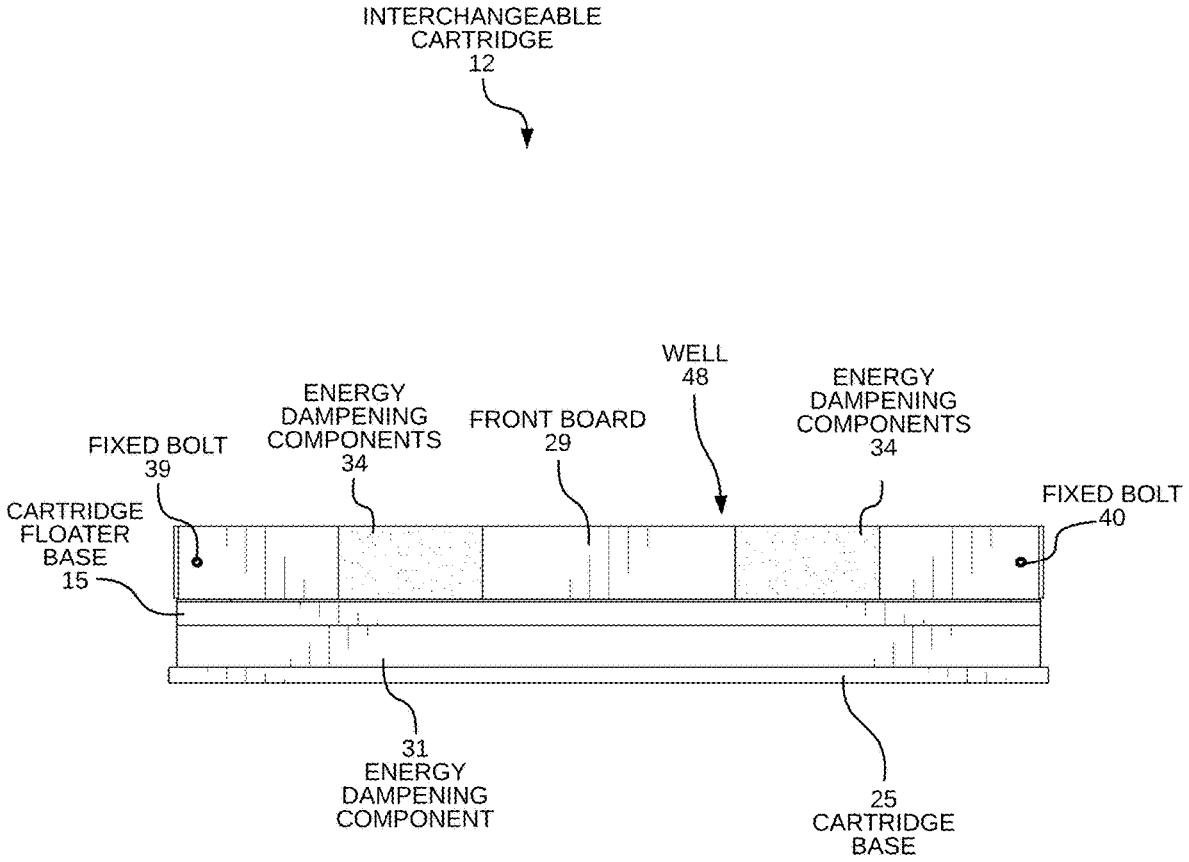
FIG. 5 is a diagram of a front orthogonal view of the interchangeable cartridge assembly.

FIG. 5 is a diagram showing a front orthogonal view of an interchangeable cartridge assembly. The front board 29 is positioned at the upper portion of the structure, providing support and alignment for the assembly. In one embodiment, the front board 29 is made of wood or engineered wood. In another embodiment, the front board 29 is made of aluminum. In yet another embodiment, the front board 29 is made of steel.

Figure 6:
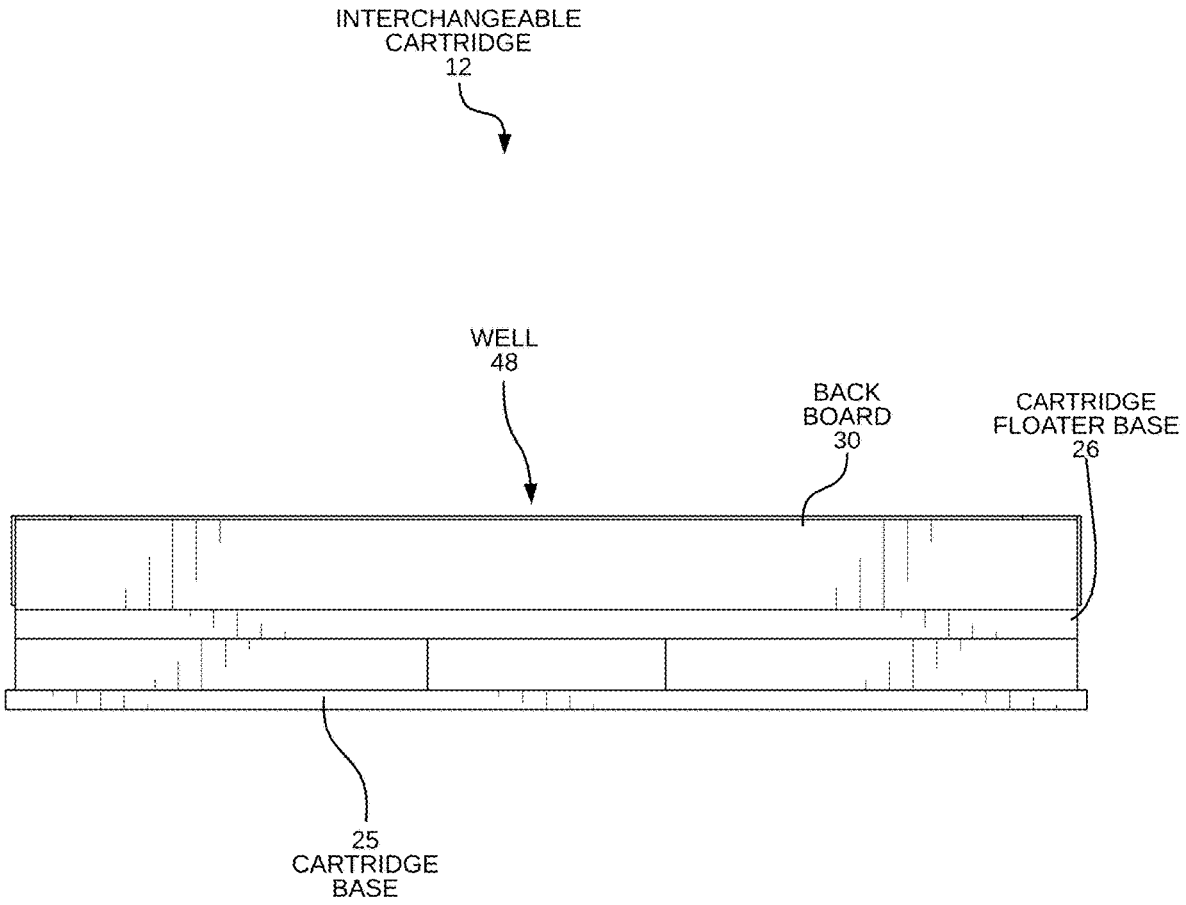
FIG. 6 is a diagram of a rear orthogonal view of an interchangeable cartridge assembly.

FIG. 6 is a diagram showing a rear orthogonal view of an interchangeable cartridge component. The view shows the back board 30 extending horizontally across the upper portion of the assembly. In one embodiment, the back board 30 is made of wood or engineered wood. In another embodiment, the back board 30 is made of steel. In yet another embodiment, the back board 30 is made of aluminum. The cartridge floater base 26 is positioned below the back board 30. In one embodiment, the cartridge floater base 26 is formed from wood, engineering wood, or plywood. In another embodiment, the cartridge floater base 26 is made of high-density polyethylene.

Figure 7:
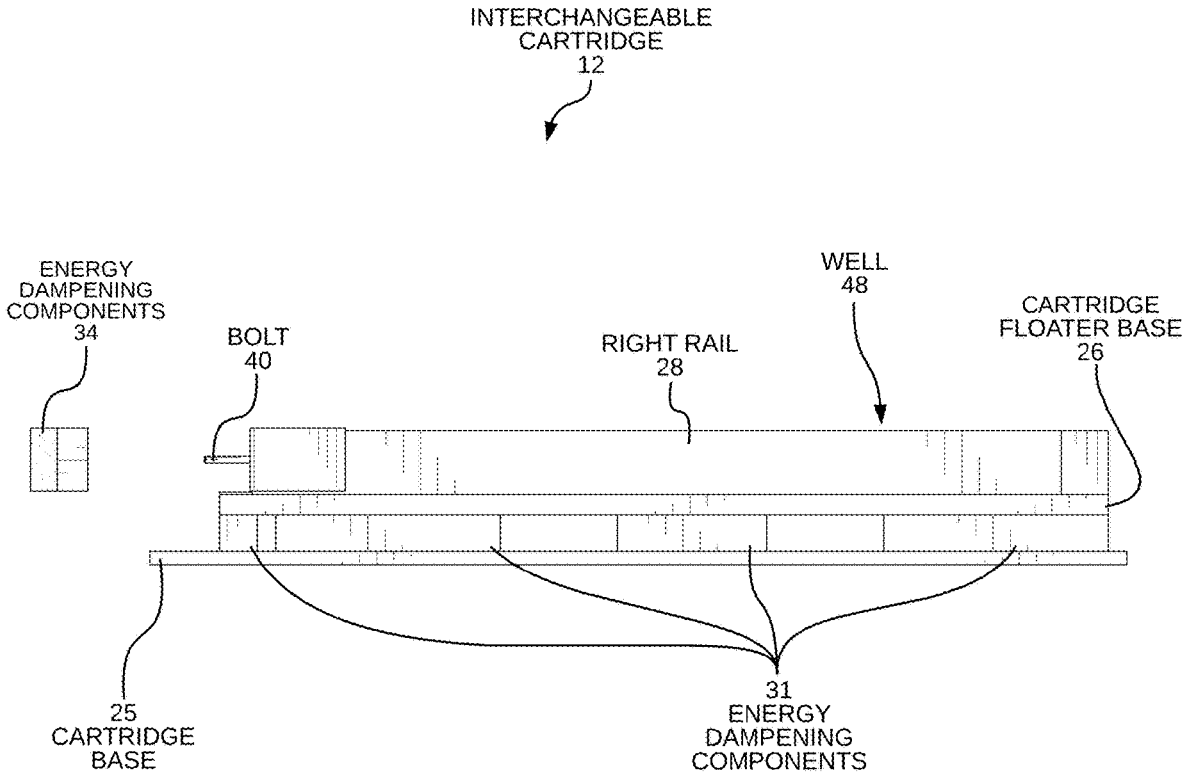
FIG. 7 is a diagram of a side orthogonal view of the interchangeable cartridge assembly.

FIG. 7 is a diagram showing a side orthogonal view of an interchangeable cartridge assembly. The cartridge base 25 and the cartridge floater base 26 are arranged in a horizontal configuration. In one embodiment, the cartridge base 25 is formed from wood, engineered wood, or plywood. In another embodiment, the cartridge base 25 is made of high-density polyethylene.

A right rail 28 extends along the upper portion of the assembly. In one embodiment, the right rail 28 is made of wood or engineered wood. In another embodiment, the right rail 28 is made of steel. In yet another embodiment, the right rail 28 is made of aluminum.

The assembly incorporates energy damping components 31 positioned between the cartridge base 25 and cartridge floater base 26. In one embodiment, the energy damping components 31 are made of foam. In one example, the foam is expanded polyethylene (EPE) foam. In another example, the foam is expanded polypropylene (EPP) beaded foam. In yet another example, the foam is polyurethane (PU) foam. In still other embodiments, energy damping components 31 are each made from different shock absorbing and vibration damping capable materials.

The bolt 40 is shown protruding from the side of the assembly, providing a means for securing components together. In one embodiment, the bolt 40 is stainless steel. In another embodiment, the bolt 40 is high-strength aluminum alloy.

Figure 8:
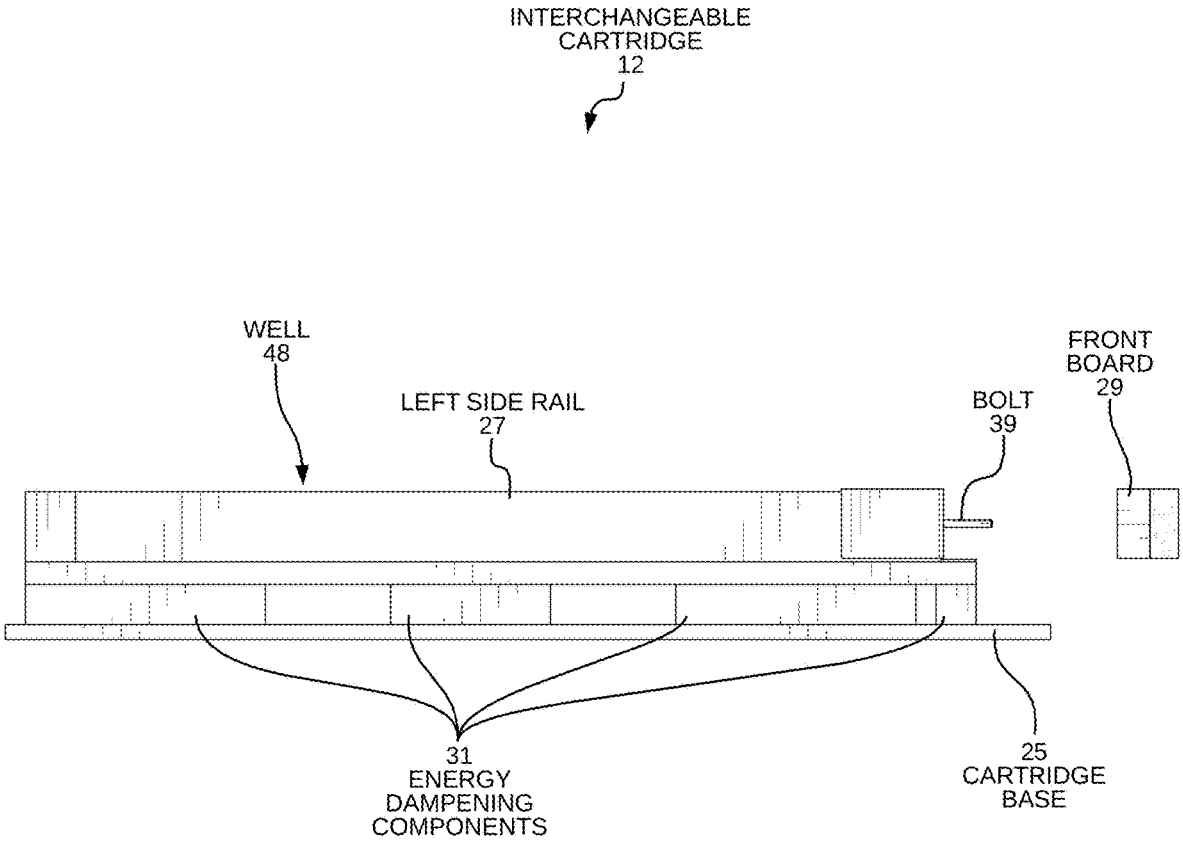
FIG. 8 is a diagram of another side orthogonal view of the interchangeable cartridge assembly.

FIG. 8 is a diagram showing a side orthogonal view of an interchangeable cartridge assembly. The left rail 27 extends horizontally across the structure. In one embodiment, the left rail 27 is made of wood or engineered wood. In another embodiment, the left rail 27 is made of steel. In yet another embodiment, the left rail 27 is made of aluminum.

Multiple energy damping components 31 are positioned along the assembly, providing cushioning and impact protection. In one embodiment, the energy damping components 31 are made of one or more of expanded polyethylene (EPE) foam, expanded polypropylene (EPP) beaded foam, polyurethane (PU) foam, or other shock absorbing capable materials.

Figure 9:
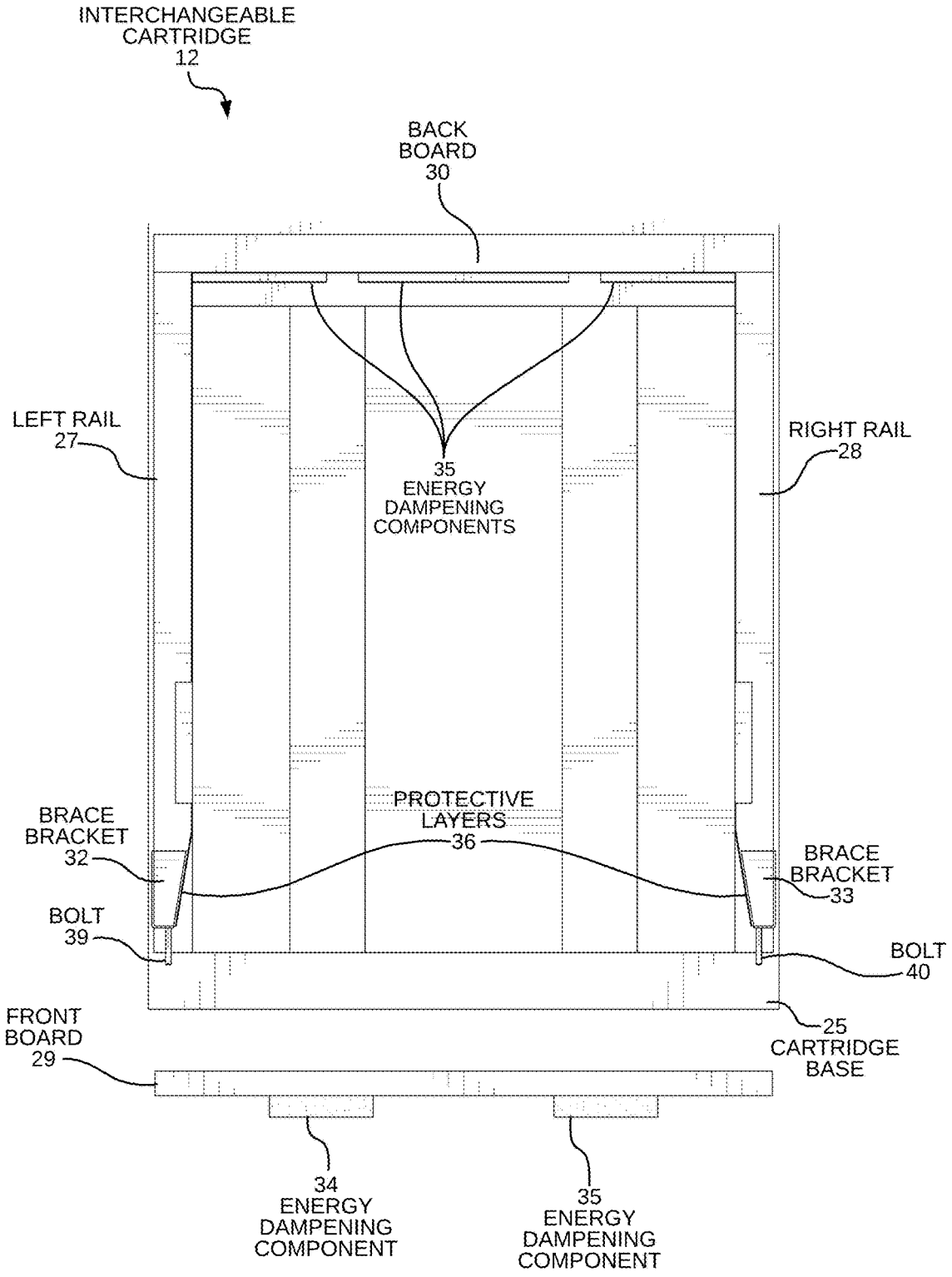
FIG. 9 is a diagram of a top view of the interchangeable cartridge assembly.

FIG. 9 is a diagram showing a top view of an interchangeable cartridge assembly. The cartridge base 25 forms the foundation of the structure. The perimeter of the assembly is defined by the left rail 27, a right rail 28, and the back board 30, which form the boundaries of the cartridge. A well is formed by front board 29, left rail 27, right rail 28, back board 30, and cartridge base 25. A load, such as a server rack, to be transported rests within this well.

The assembly incorporates energy damping components 34 and 35 positioned in multiple locations—both in the upper portion of the assembly and along the bottom of the cartridge base 25. In one embodiment, the energy damping components 34 and 35 are formed from one or more of expanded polyethylene (EPE) foam, expanded polypropylene (EPP) beaded foam, polyurethane (PU) foam, or other shock absorbing capable materials.

Protective layers 36 extend across the interior surface side rails 27 and 28. In one embodiment, the protective layers 36 are made of felt.

In one embodiment, the top surface of cartridge floater base 26 consists of one or more metal layers 37 made of aluminum and one or more non-metal layers 38 made of wood or engineered wood. In another embodiment, metal layers 37 are made of steel, and non-metal layers 38 are made of fiberglass or high-impact plastic. The metal and non-metal layers are selected or omitted to support casters and other support features beneath the load.

The structure is secured using bolt 39 and bolt 40, which are positioned near the front corners of the assembly. In one embodiment, the bolts are stainless steel. In another embodiment, the bolts are high-strength aluminum alloy.

Figure 10:
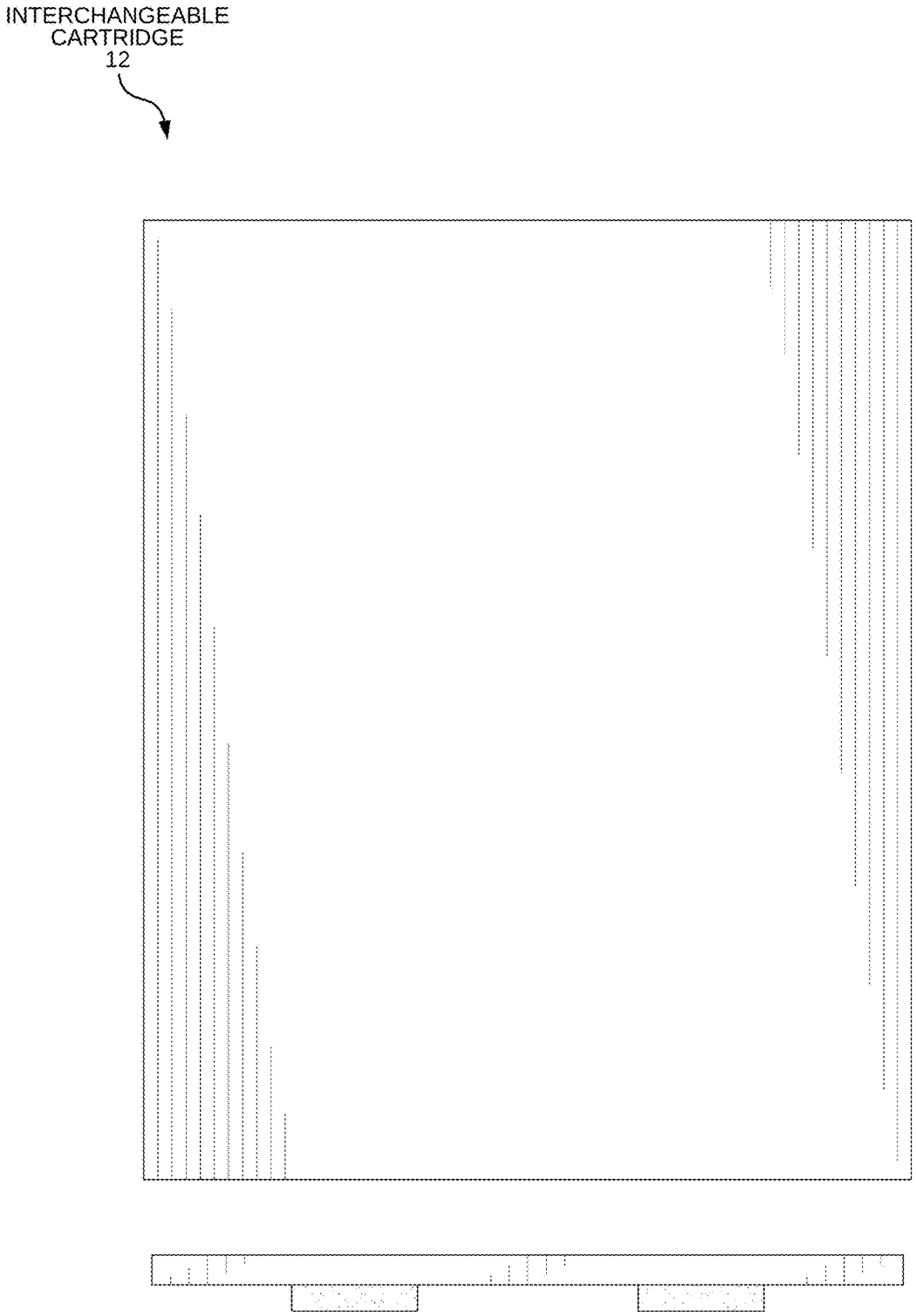
FIG. 10 is a diagram of a bottom orthogonal view of an interchangeable cartridge for a shipping crate system.

FIG. 10 is a diagram showing a bottom orthogonal view of an interchangeable cartridge for a shipping crate system. The design of the interchangeable cartridge demonstrates a simple yet functional configuration that enables the cartridge to be removed and replaced within the shipping crate system. In one embodiment, the base structure is formed from wood, engineered wood, or plywood. In another embodiment, the base structure is made of high-density polyethylene.

Figure 11:
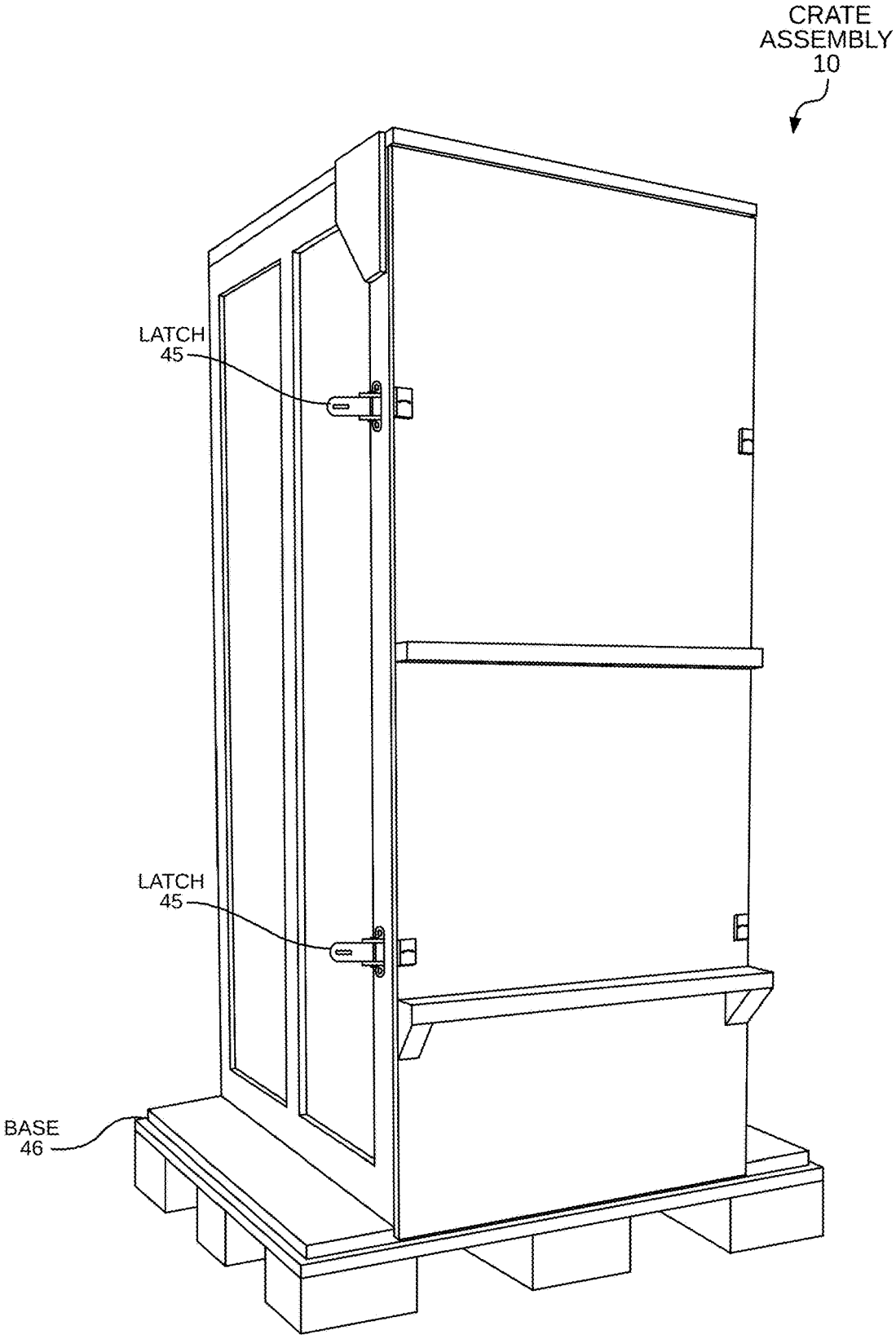
FIG. 11 is a diagram showing a perspective view of the crate assembly with the front panel installed.

FIG. 11 is a diagram showing a perspective view of the crate assembly 10 with the front panel 16 installed. The crate assembly 10 includes a rectangular frame structure mounted on a base 46 with support blocks. In this example, the front panel 16 is secured with a latching mechanism 45. In one embodiment, two latching mechanisms are utilized. In some embodiments, the latching mechanisms are twist locks. In another embodiment, the latching mechanisms are cam locks.

The base of the crate incorporates a pallet-style design with multiple support blocks that facilitate handling by forklifts or pallet jacks. In one embodiment, the support blocks are made of hardwood. In another embodiment, the support blocks are made of high-density plastic.

Figure 12:
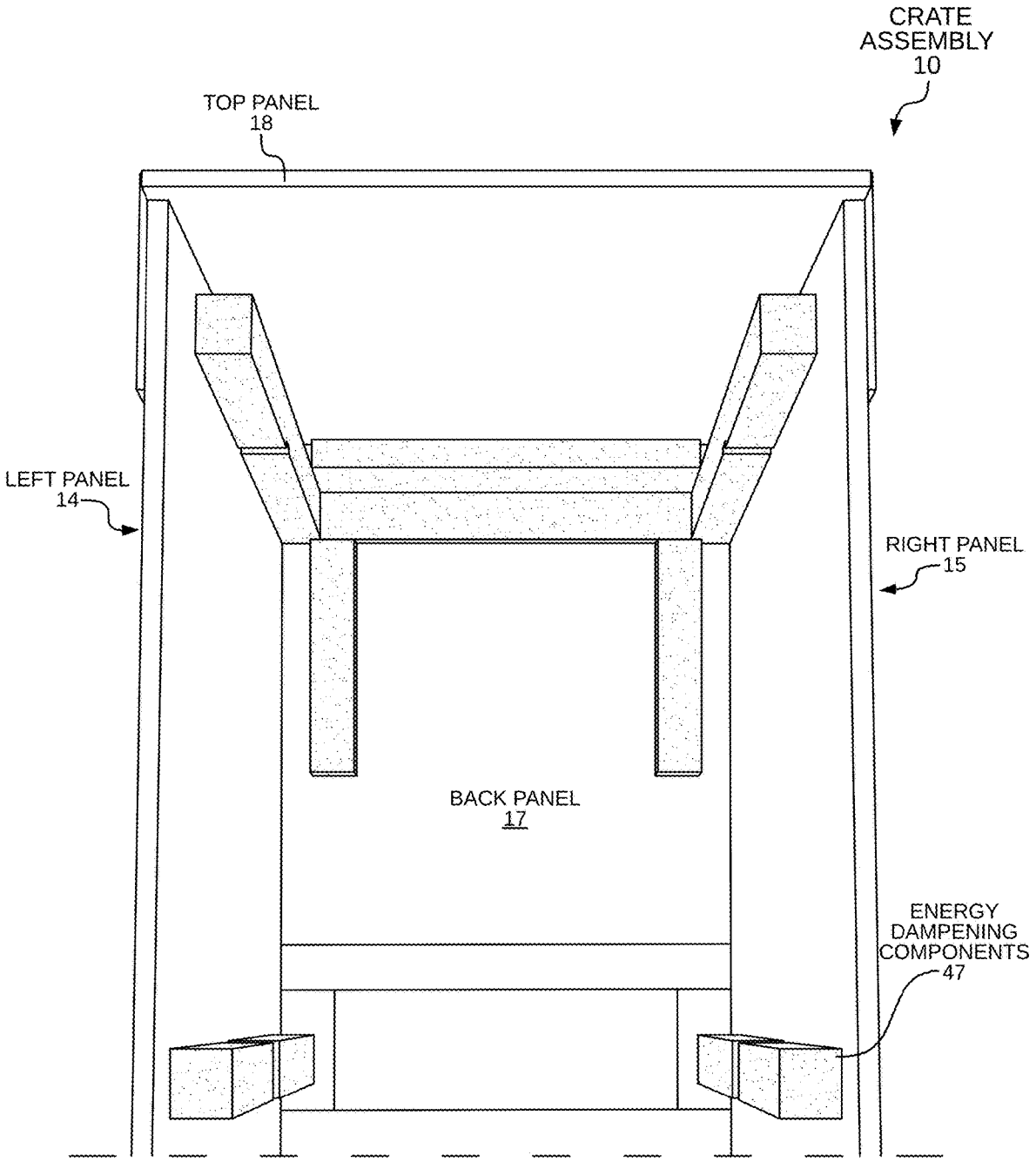
FIG. 12 is a diagram of an interior view of the crate assembly showing internal panel configuration.

FIG. 12 is a diagram showing an interior view of the crate assembly 10, illustrating the internal configuration of panels with a plurality of energy damping components 47. The crate assembly 10 comprises multiple panels that form the interior structure. The top panel 18 forms the upper boundary of the crate assembly 10. The left panel 14 and right panel 15 are positioned on opposite sides of the crate assembly 10, extending vertically. The back panel 17 is situated at the rear of the crate assembly 10, connecting with the left panel 14 and right panel 15.

In one embodiment, the panels include integrated energy damping components 47, which appear as protruding elements from the interior surfaces. In another embodiment, the energy damping components 47 are separate inserts attached to the panels. In another embodiment, the energy damping components 47 are a combination of integrated and separate elements.

The energy damping components 47 are arranged in a symmetrical pattern along the panels to provide protection for contents placed within the crate assembly 10. In one embodiment, the energy damping components 47 are made of one or more of expanded polyethylene (EPE) foam, expanded polypropylene (EPP) beaded foam, polyurethane (PU) foam, or other shock absorbing capable materials.

Figure 13:
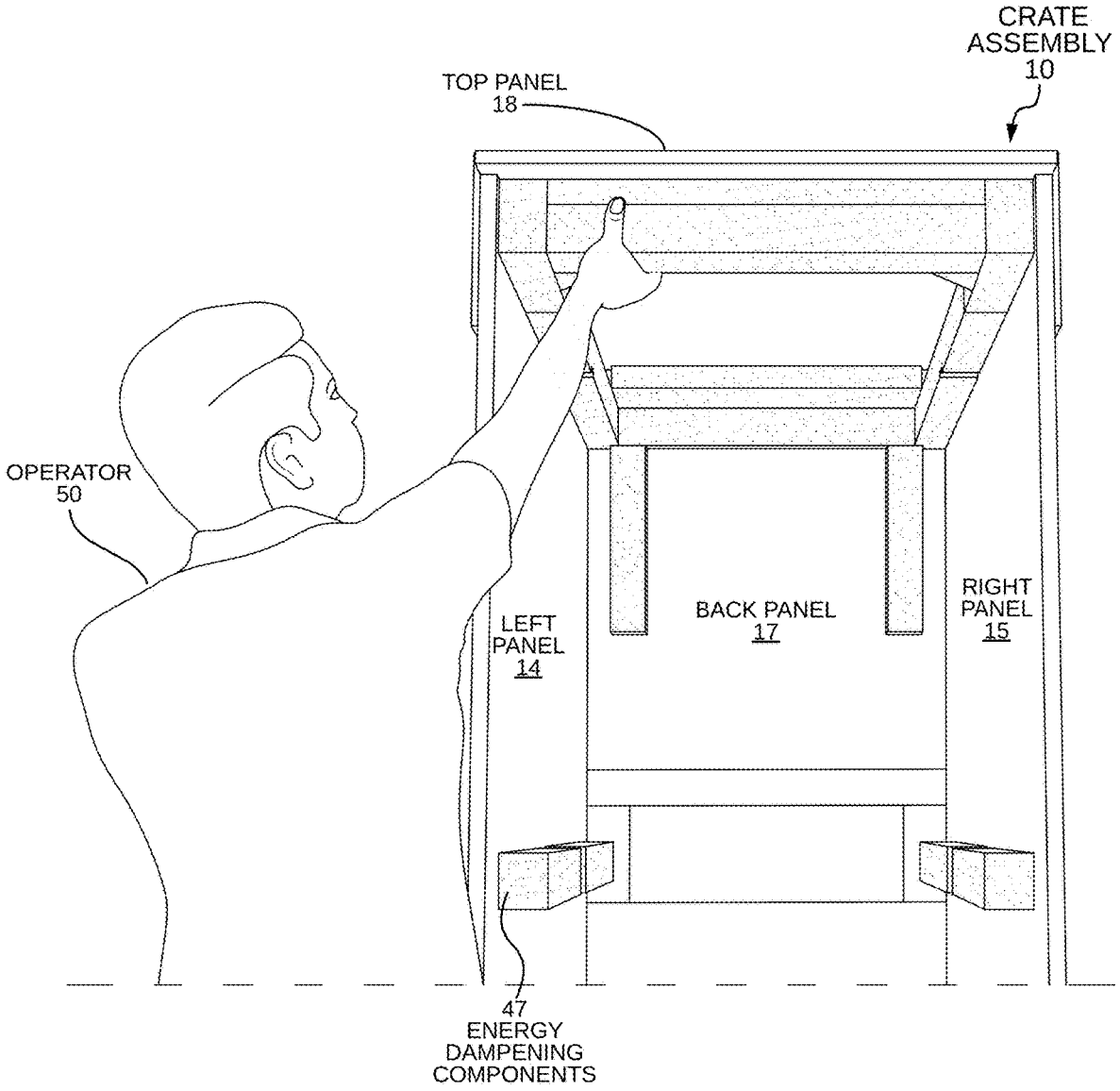
FIG. 13 is a diagram of a front view of the crate assembly during an installation process.

FIG. 13 is a diagram showing a front view of the crate assembly 10 during an installation process. The crate assembly 10 comprises several panels arranged to form an enclosure, including the top panel 18, the left panel 14, the right panel 15, and the back panel 17. The figure shows the interior configuration of the crate assembly 10, with the panels positioned to create a protective enclosure.

Figure 14:
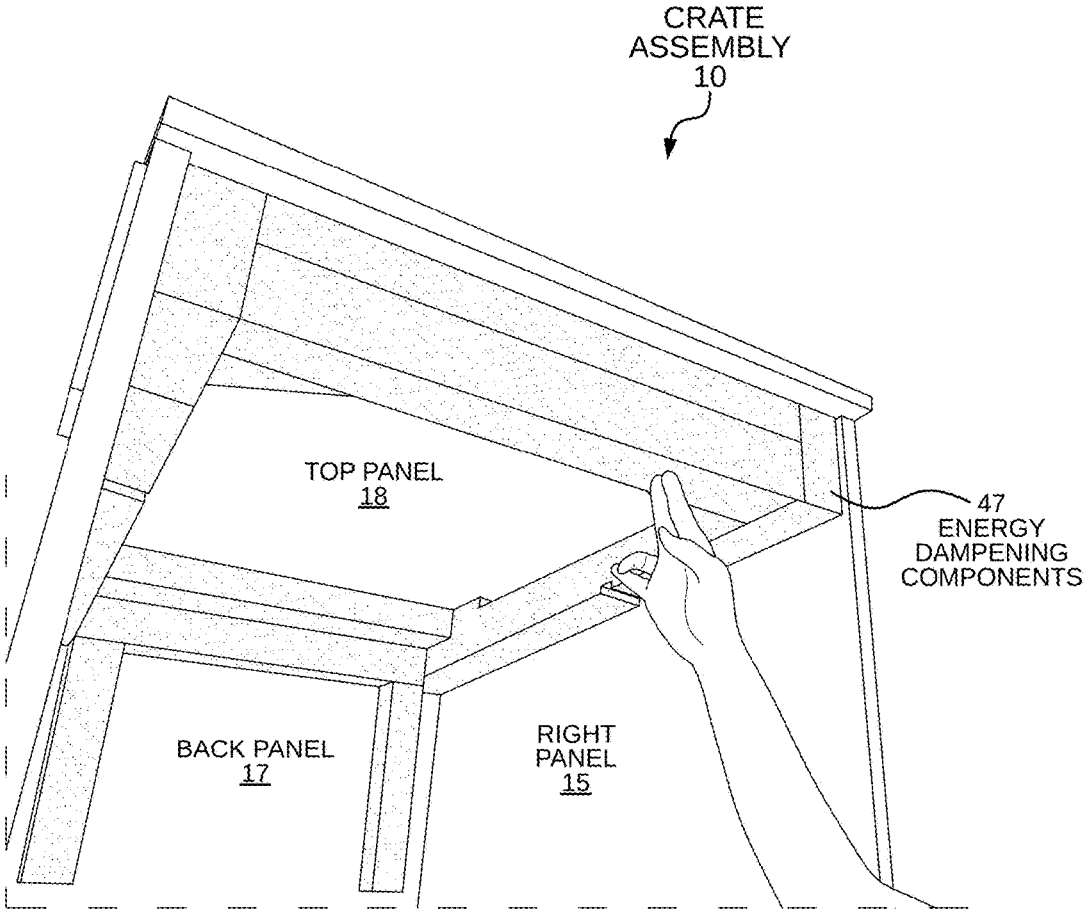
FIG. 14 is a diagram of a partial cutaway view of the crate assembly showing interior energy damping components.

FIG. 14 is a diagram of a partial cutaway view of the crate assembly 10 showing interior energy damping components 47.

Figure 15:
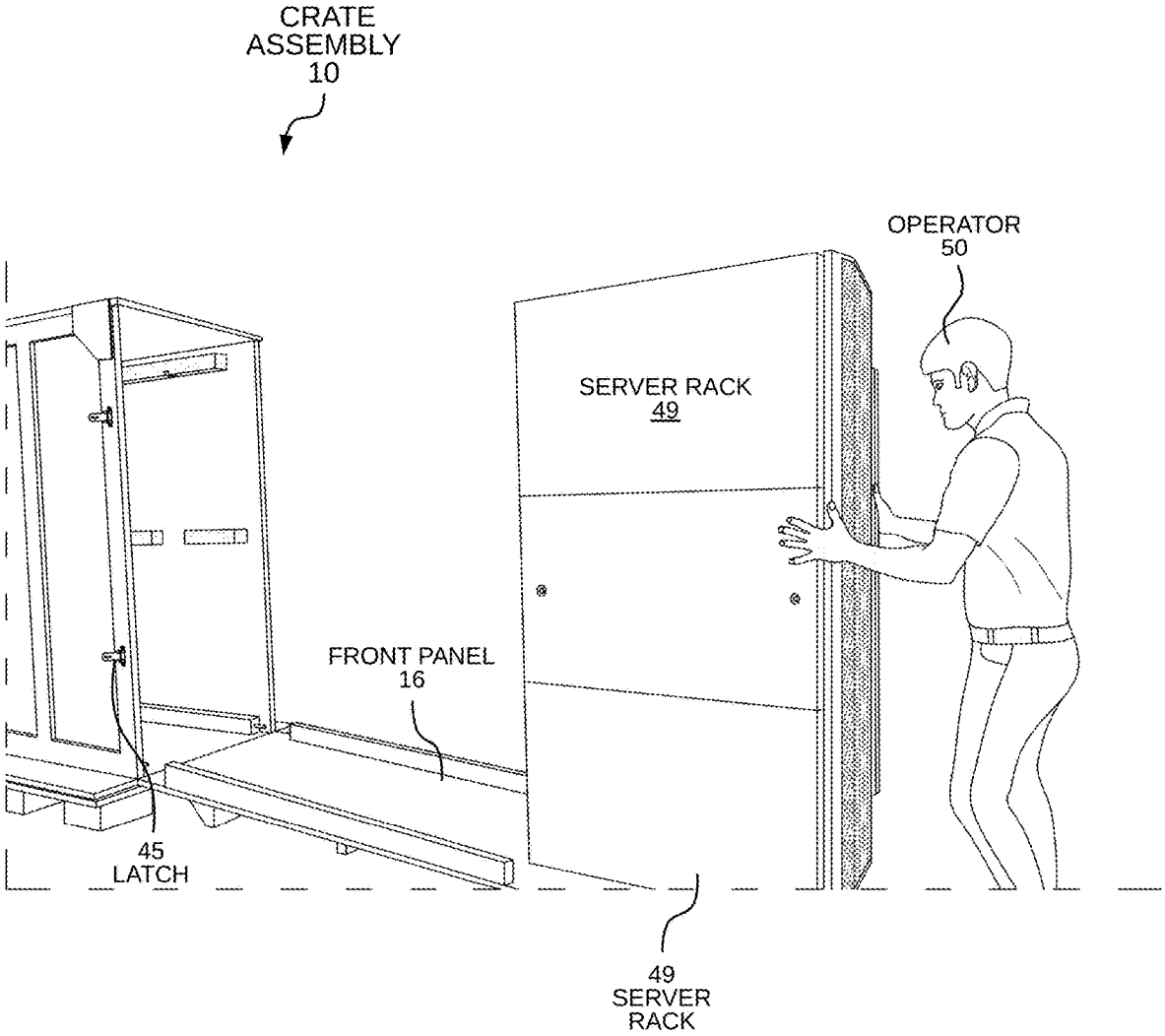
FIG. 15 is a diagram of a perspective view of a server rack loading operation.

FIG. 15 is a diagram showing a perspective view of a server rack loading operation. As shown in FIG. 15, an operator 50 pushes server rack 49 along front panel 16 of the crate assembly during the loading process. In this embodiment, front panel 16 is functioning as a loading ramp to facilitate the loading of server rack 49 into crate assembly 10.

Figure 16:
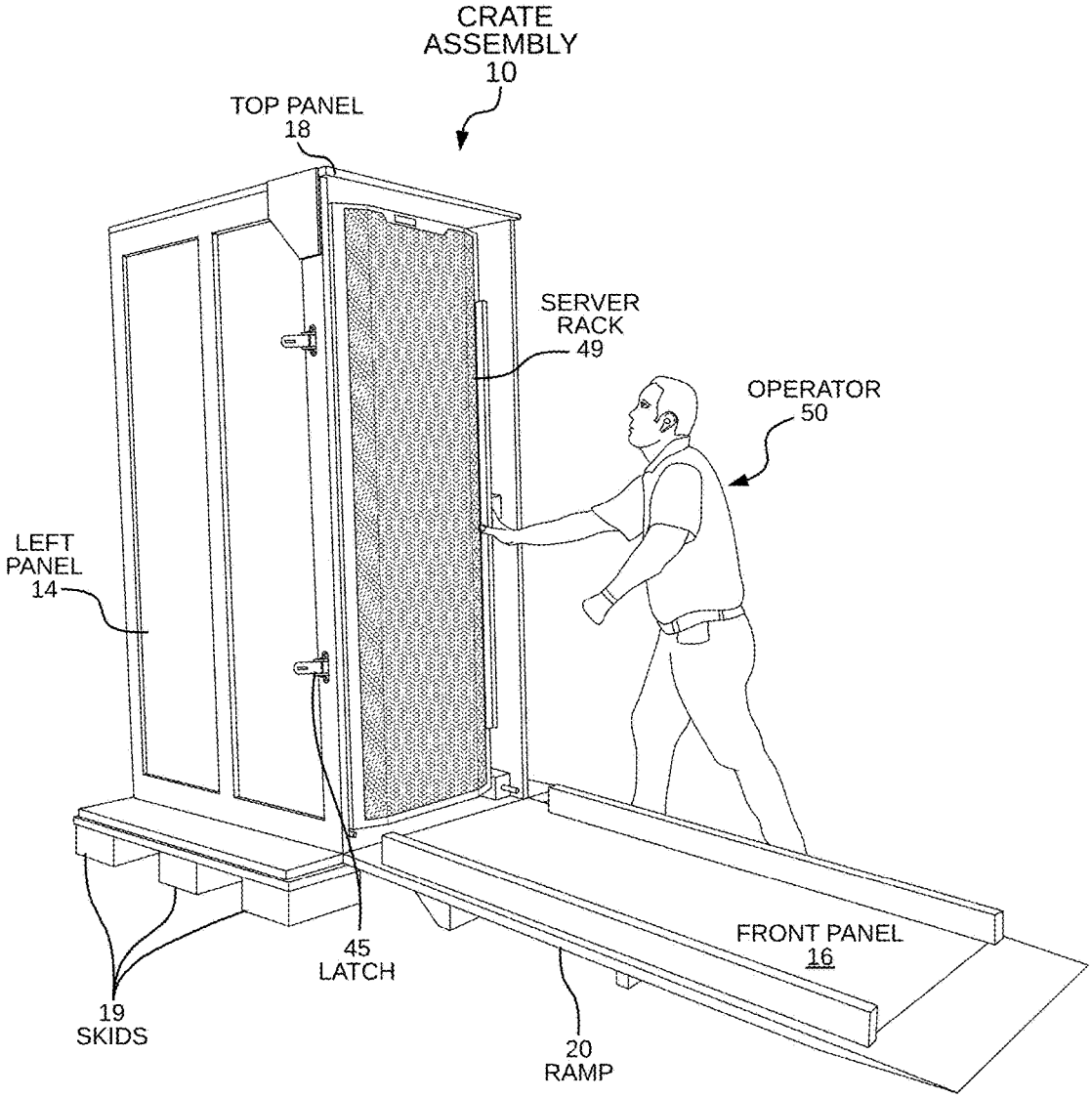
FIG. 16 is a diagram of a perspective view of the crate assembly during a server rack loading operation.

FIG. 16 is a diagram showing a perspective view of the crate assembly 10 during a server rack loading operation.

Figure 17:
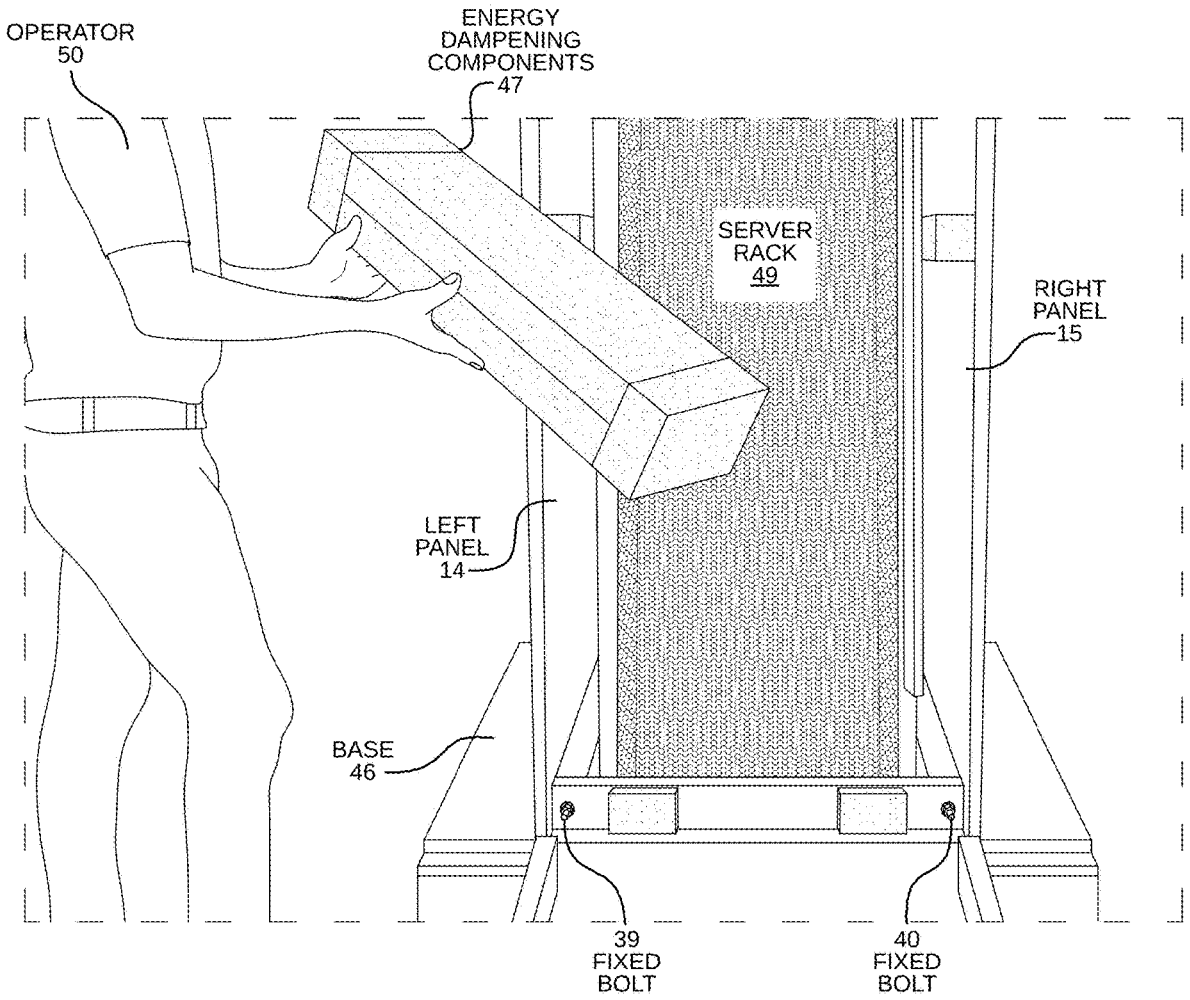
FIG. 17 is a diagram of a sectional view showing the assembly configuration of components in a shipping crate.

FIG. 17 is a diagram showing an operator inserting energy damping components 47 to secure the server rack 49 within the crate assembly 10.

Figure 18:
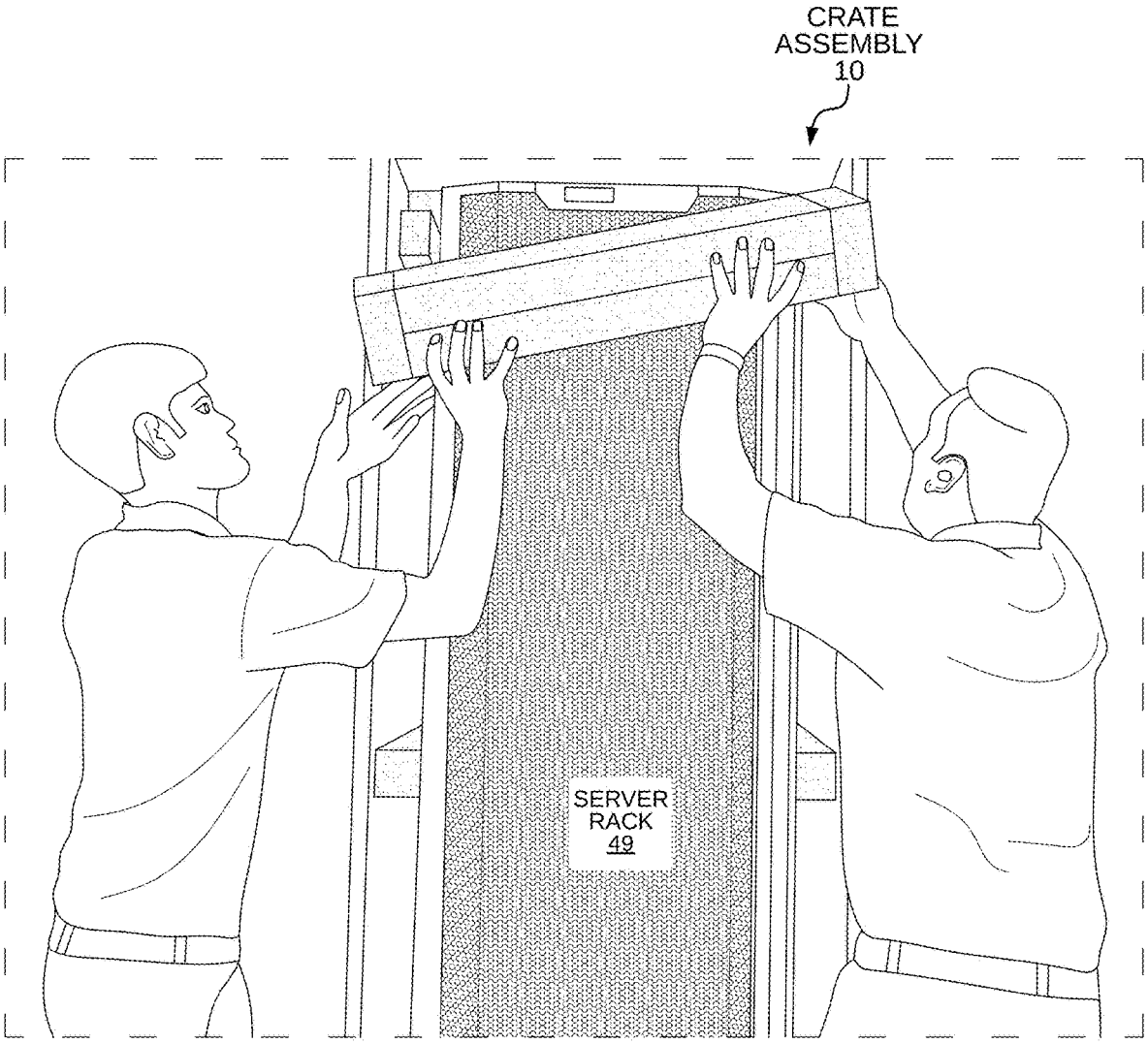
FIG. 18 is a diagram of a perspective view showing the installation of components in the crate assembly.

FIG. 18 is a diagram showing a perspective view of the installation of components in the crate assembly 10. The shock absorbing components 47 are secured to the interior surfaces of the crate assembly 10, providing protection for the contents. In one embodiment, the shock absorbing components 47 are pre-cut foam inserts that are press-fit into designated spaces within the crate assembly 10. In another embodiment, the shock absorbing components 47 are modular units that are secured using hook-and-loop fasteners, magnets, adhesives, or interlocking mechanisms for ease of installation.

Figure 19:
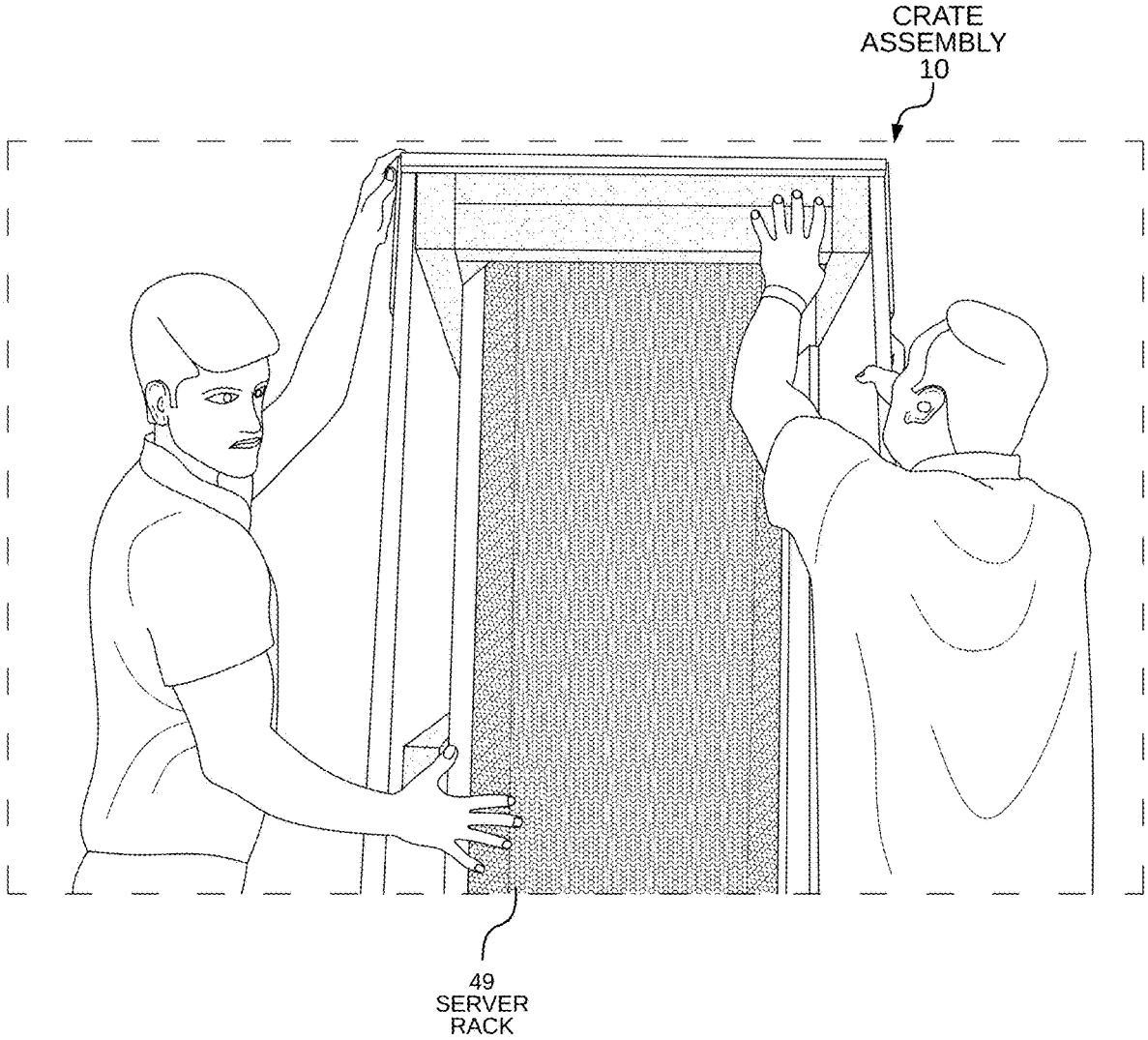
FIG. 19 is a diagram of another perspective view showing the installation of components within the crate assembly.

FIG. 19 is another diagram showing a perspective view of the installation of components within the crate assembly 10. As shown in FIG. 19, the shock absorbing components 47 are positioned and secured within the interior of the crate assembly 10. The design of the crate assembly 10 allows for proper installation and positioning of protective elements that help safeguard contents during transport. In one embodiment, the installation process includes a series of alignment markers or guides on both the crate frame and the shock absorbing components to ensure correct positioning. The assembly configuration shown in FIG. 17, FIG. 18, and FIG. 19 demonstrates a modular approach to installation of energy damping components that facilitates easy maintenance, replacement of worn parts, and customization for different types of server rack equipment.

Figure 20A:
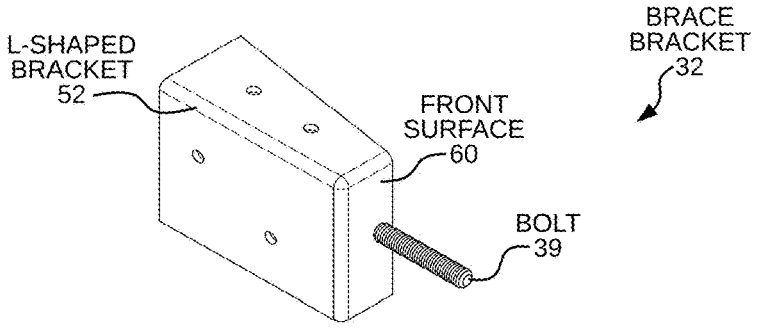
FIG. 20A is a diagram of a perspective view of a brace bracket.

FIG. 20A is a diagram showing a perspective view of a brace bracket. The brace bracket assembly comprises a front surface 60 and an L-shaped bracket component 52. The front surface includes a bolt 39 positioned on its face. The brace bracket 32 is formed of any suitable material capable of securely maintaining the front board fastened to the side rails during transport. In one embodiment, the brace bracket is made of steel. In another embodiment, the brace bracket is made of aluminum alloy.

The brace bracket 32 is constructed from rigid materials suitable for providing structural support and bracing. In one embodiment, the assembly is coated with a corrosion-resistant finish. In another embodiment, the assembly is left uncoated for applications where corrosion resistance is not required. In some embodiments, the L-shaped bracket component 52 is formed from a single section of sheet metal and the bolt 39 is welded to the front surface 60.

Figure 20B:
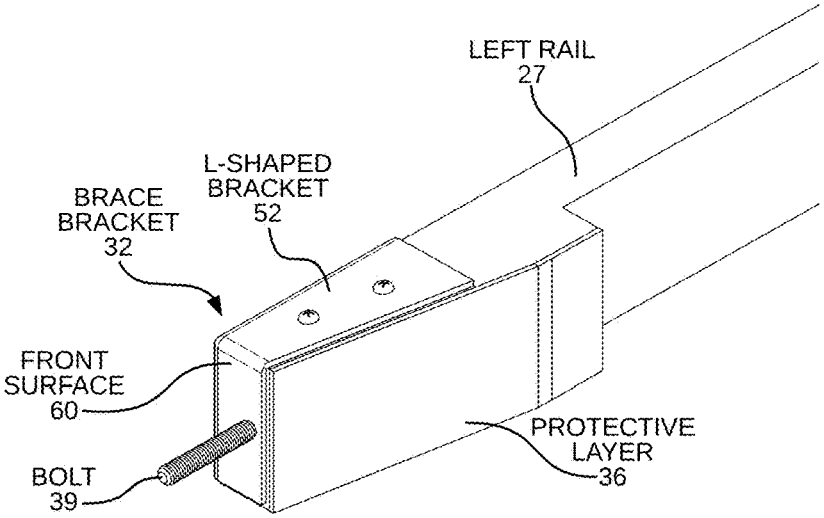
FIG. 20B is a diagram of a perspective view of a brace bracket attached to a side rail.

FIG. 20B is a diagram showing a perspective view of a brace bracket attached to a side rail. Brace bracket 32 attaches to left rail 27 using mounting holes located on L-shaped bracket component 52. Bolt 39 allows a front board to be secured to left rail 27. The design allows for secure attachment of front board 29 while maintaining a simple, functional configuration. In one embodiment, the brace bracket assembly is used to reinforce corners of the crate assembly. In another embodiment, the brace bracket assembly 32 is used to attach additional components to the crate assembly.

Figure 20C:
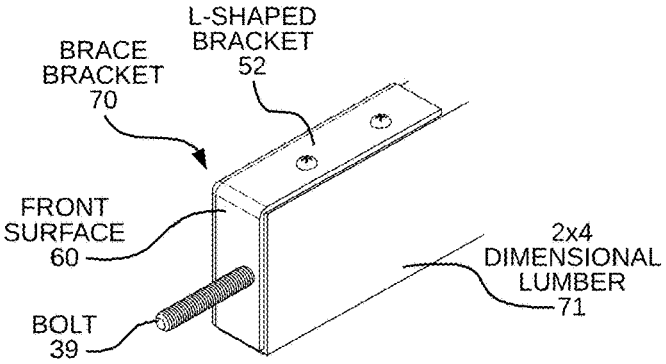
FIG. 20C is a diagram of a perspective view of a brace bracket attached to dimensional lumber.

FIG. 20C is a diagram showing a brace bracket attached to dimensional lumber. In this embodiment, the brace bracket has dimensions configured to fit onto cartridge side rails made from 2×4 dimensional lumber. 2×4 dimensional lumber has a nominal size of 2"×4", but commonly has actual dimensions of 1.5"×3.5". In other embodiments, brace brackets are configured to fit on side rails made from 3×4, 4×4, or other types of dimensional lumber. This increases ease of construction of toolless open front wells and insertable cartridges by utilizing commonly available materials.

Figure 21:
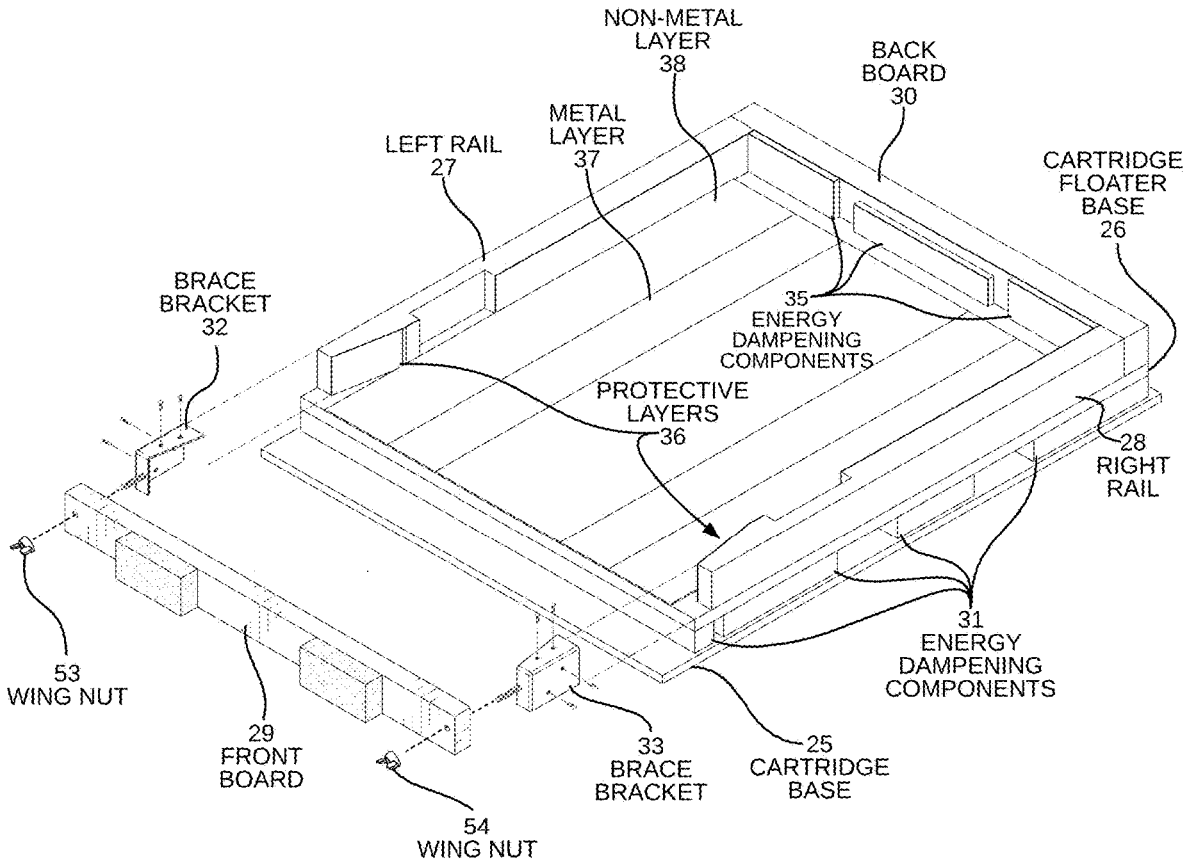
FIG. 21 is a diagram of an exploded view of a cartridge assembly showing attachment of components to side rails.

FIG. 21 is a diagram showing an exploded view of a cartridge assembly showing how the front board 29 is toollessly attached to side rails 27 and 28.

Figure 22:
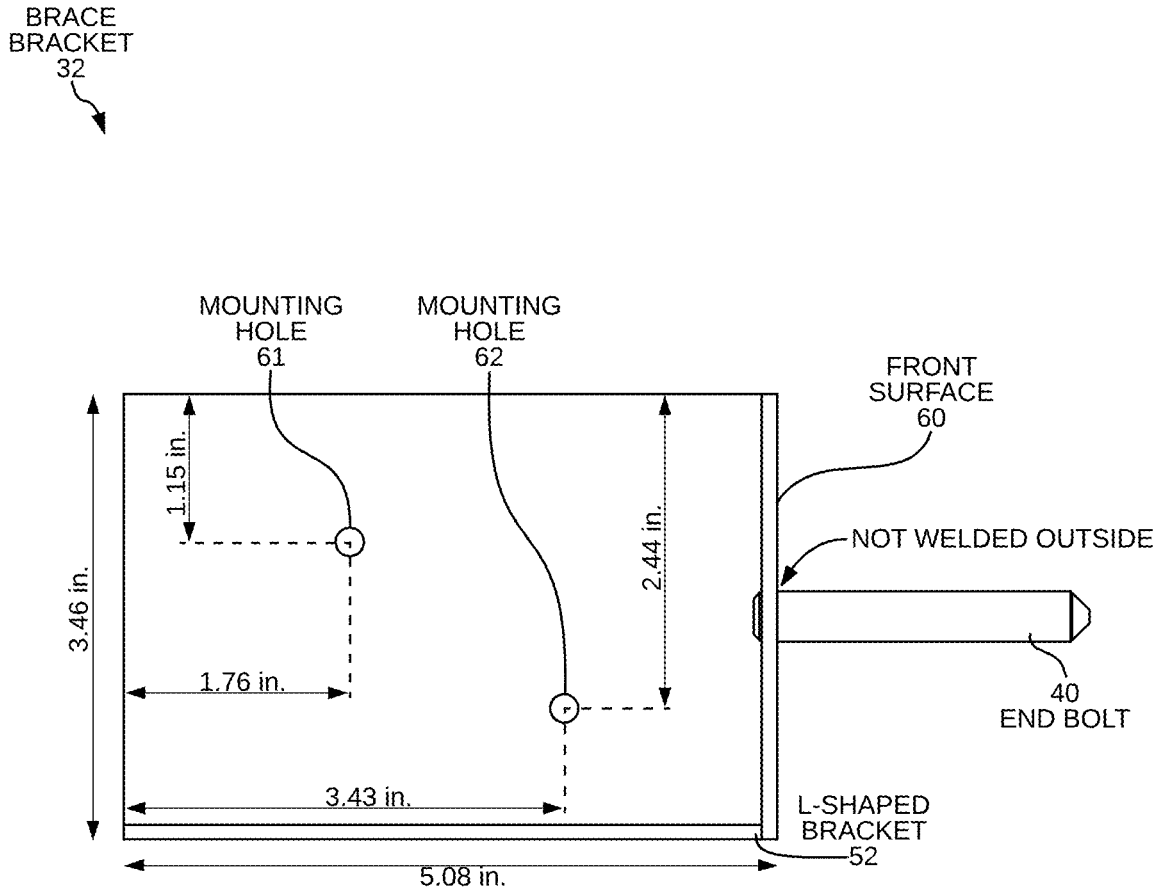
FIG. 22 is a side view of a brace bracket in accordance with one embodiment.
Figure 23:
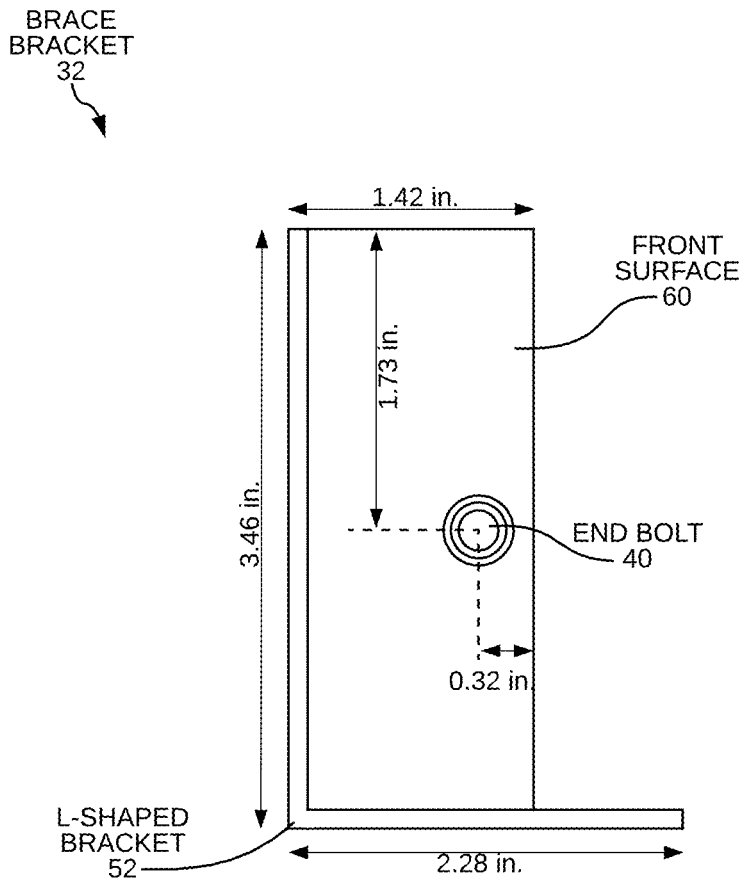
FIG. 23 is a front view of the brace bracket.
Figure 24:
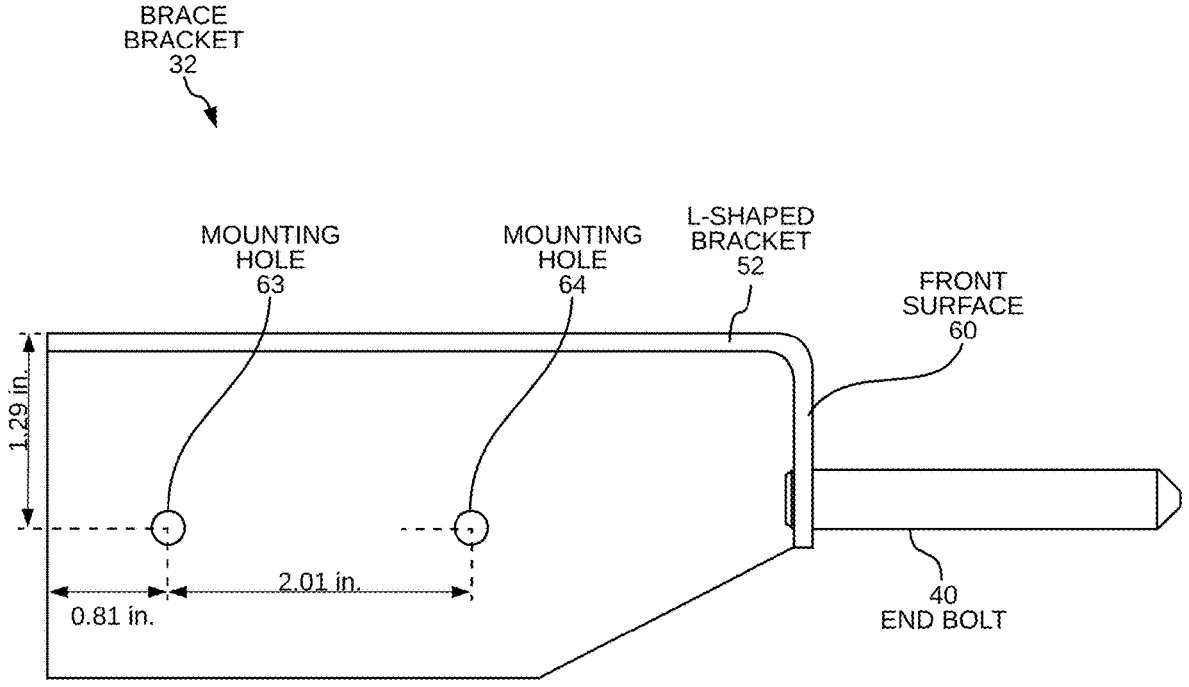
FIG. 24 is a top-down view of the brace bracket.

FIGS. 22-24 illustrate orthogonal views of a brace bracket 32 in accordance with one embodiment. The brace bracket 32 comprises an L-shaped structure with specific design features for mounting and support purposes. It is appreciated that in other embodiments, brace brackets have different dimensions configured to fit onto the cartridge side rails, dimensional lumber, or other structures.

FIG. 22 is a side view of a brace bracket in accordance with one embodiment. The brace bracket 32 has a length of 5.08 inches and a height of 3.46 inches. Brace bracket 33 includes an end bolt 40 mounted to a front surface 60. Brace bracket 33 also includes mounting holes 61 and 62. In this embodiment, mounting hole 61 is positioned 1.76 inches from a left edge of the brace bracket and 1.15 inches from a top edge of the brace bracket, and mounting hole 62 is positioned 3.43 inches from the left edge of the brace bracket and 2.44 inches from the top edge of the brace bracket. The drawing has a label "NOT WELDED OUTSIDE" indicating that end bolt 40 is not affixed to front surface 60 with external welds. In some embodiments, the brace bracket 33 has a height dimension over two-thirds the size of the length dimension adds to the rigidity of the brace bracket.

FIG. 23 is a front view of the brace bracket 32. The brace bracket 33 has a height of 3.46 inches and a width of 2.28 inches, forming a 90-degree angle. The end bolt 40 is positioned 1.73 inches from the top edge of brace bracket 33. In some embodiments, the brace bracket 33 has a width dimension over one-half the size of the height dimension to increase the rigidity of the brace bracket.

FIG. 24 is a top-down view of the brace bracket 32. The brace bracket 32 has two mounting holes 63 and 64 are positioned 2.01 inches apart, with the first mounting hole 63 located 0.81 inches from the left edge of the brace bracket. Both mounting holes 63 and 64 are positioned 1.29 inches from the top edge of brace bracket 33. An end bolt 40 extends from the side at a 90-degree angle. In this embodiment, end bolt 40 is a ⅜ inch bolt.

In one embodiment, the brace bracket is constructed from stainless steel to provide corrosion resistance and strength. In another embodiment, the brace bracket is made from a high-strength aluminum alloy to reduce weight while maintaining structural integrity.

The brace bracket is designed to withstand a wide range of temperatures. In one embodiment, the brace bracket is coated with a specialized thermal-resistant finish, allowing it to maintain its structural properties in temperatures ranging from −60° C. to +100° C.

In one embodiment, the brace bracket is manufactured using environmentally friendly processes and materials. The bracket is designed to be 100% recyclable at the end of its lifecycle. The brace bracket is engineered to be chemically inert. In one embodiment, the bracket is treated with a chemical-resistant coating to enhance its inertness and prevent any potential reactions with the contents of the crate or environmental factors during shipping and storage.

In another embodiment, the dimensions of the brace bracket are scaled up or down to accommodate different sizes of crate assemblies. In one embodiment, the mounting holes in the brace bracket are threaded to accept screws directly, eliminating the need for separate nuts and simplifying the assembly process. In another embodiment, the mounting holes are oversized and include integrated bushings to allow for minor adjustments during installation.

As indicated in FIG. 22 ("NOT WELDED OUTSIDE" label), the end bolt 40 is not welded to the front surface 60. Avoiding welding on the front surface 60 ensures that after installation of the front board, the front surface 60 is flush with and forms a secure contact with the front board. In some embodiments, portions of the brace bracket are reinforced using a cold-forming process instead of welding. In another embodiment, portions of the brace bracket are strengthened using a high-strength adhesive bonding process.

The end bolt 40 shown in the top-down view (FIG. 24) is a critical component of the bracket's mounting system. In one embodiment, this bolt is a ⅜ inch bolt. In another embodiment, this bolt is replaced with a metric M10 bolt for compatibility with international standards. In yet another embodiment, the bolt is integrated directly into the bracket as a stud, reducing the number of separate components in the assembly.

Figure 25:
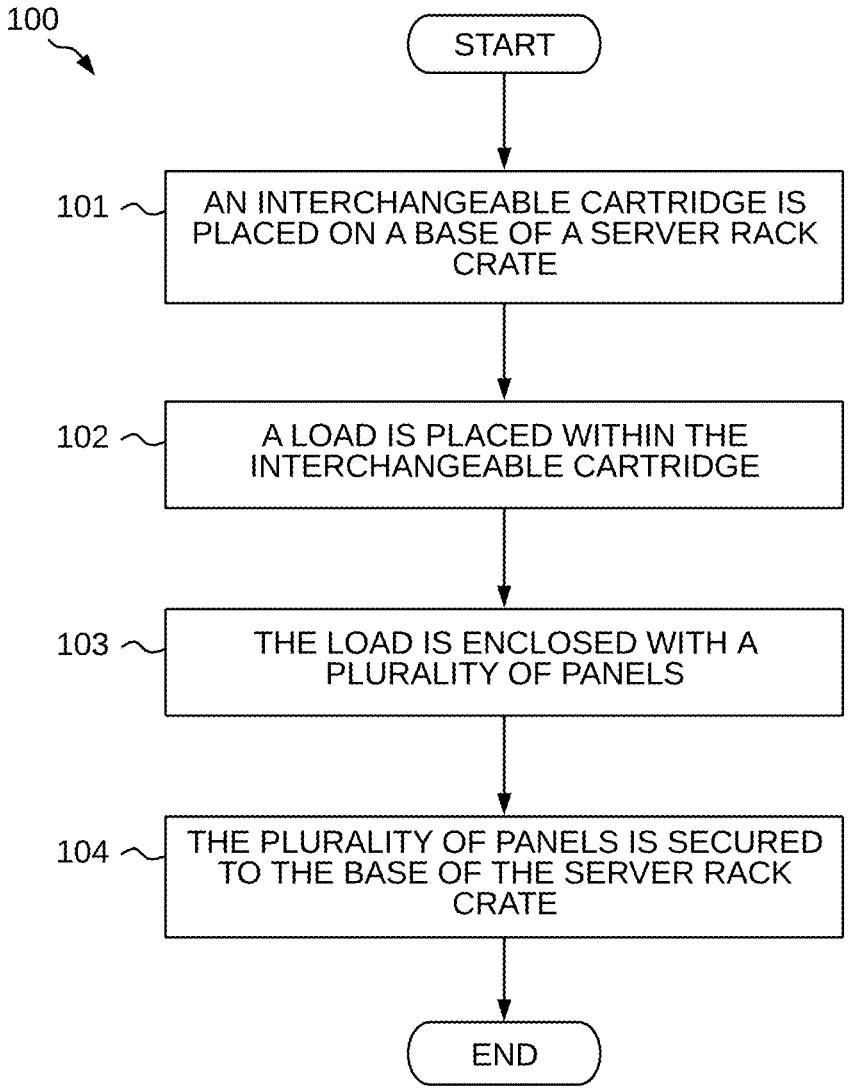
FIG. 25 is a flowchart of a method for using an interchangeable cartridge to secure a load on a server rack crate.

FIG. 25 is a diagram showing a flowchart of a method 100 for using an interchangeable cartridge to secure a load on a server rack crate.

In a first step (step 101), an interchangeable cartridge is placed on a base of a server rack crate.

In a second step (step 102), a load is placed within the interchangeable cartridge.

In a third step (step 103), the load is enclosed with a plurality of panels.

In a fourth step (step 104), the plurality of panels is secured to the base of the server rack crate.

Figure 26:
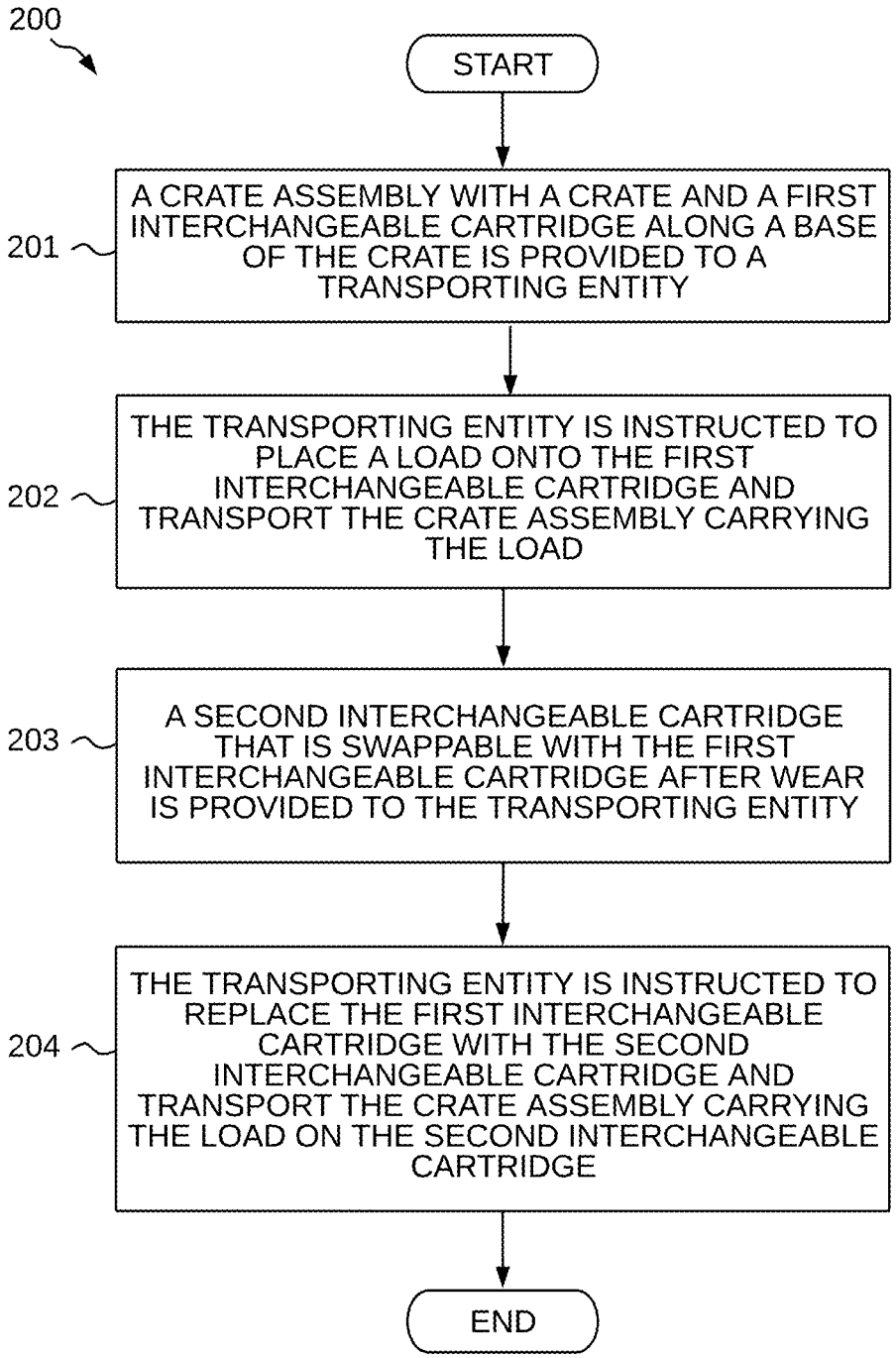
FIG. 26 is a flowchart of a method for providing replacement interchangeable cartridges to a transporting entity after usage thereby extending the life of a crate.

FIG. 26 is a diagram showing a flowchart of a method 200 for providing replacement interchangeable cartridges to a transporting entity after usage thereby extending life of the crate assembly.

In a first step (step 201), a crate assembly with a crate and an interchangeable cartridge along a base of the crate is provided to a transporting entity.

In a second step (step 202), the transporting entity is instructed to place a load onto the cartridge and transport the crate assembly carrying the load.

In a third step (step 203), a second interchangeable cartridge that is swappable with the first interchangeable cartridge after wear is provided to the transporting entity.

In a fourth step (step 204), the transporting entity is instructed to replace the first interchangeable cartridge with the second interchangeable cartridge and transport the crate assembly carrying the load on the second interchangeable cartridge.

The novel method 200 extends the life of the crate. After the interchangeable cartridge is worn, the interchangeable cartridge is replaced and swapped with a new interchangeable cartridge instead of needing to replace the entire crate. Replacing an interchangeable cartridge instead of an entire crate assembly increases the effective lifespan of the crate. In addition, replacing the interchangeable cartridge instead of the entire crate decreases shipping costs and reduces environmental impact.

Figure 27:
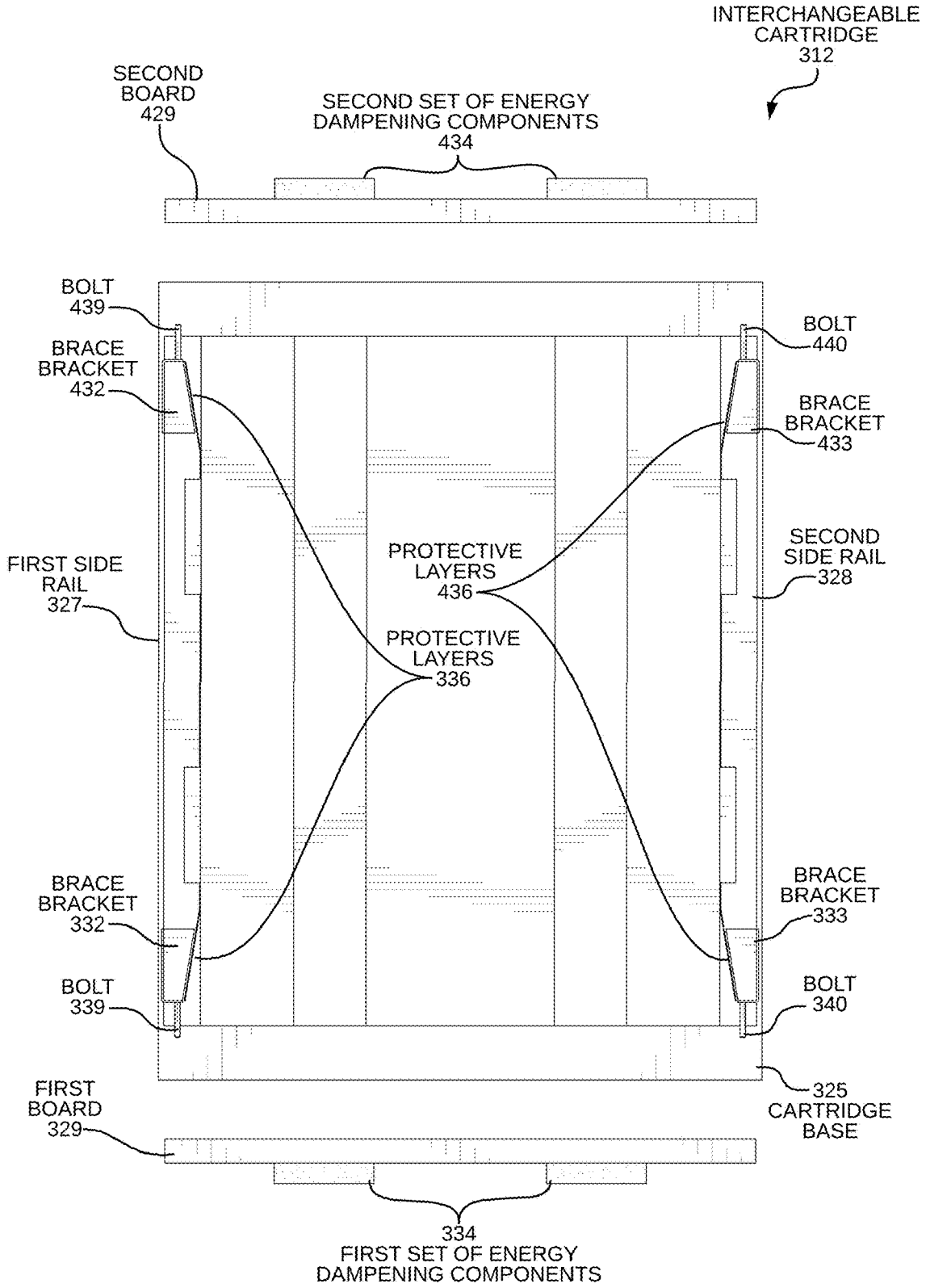
FIG. 27 is a top view diagram of another embodiment of an interchangeable cartridge.

FIG. 27 is a diagram showing a top view of another embodiment of an interchangeable cartridge assembly 312. The cartridge base 325 forms the foundation of the structure. Sidewalls of the assembly are defined by a first rail 327 and a second rail 328. A well is formed by a first board 329, first rail 327, second rail 328, a second board 429, and cartridge base 325. A server rack to be transported rests within this well.

The assembly 312 incorporates a first set of energy damping components 334 and a second set of energy damping components 434 positioned in multiple locations. Energy damping components 334 and 434 are positioned on the exterior surfaces of first and second boards 329 and 429. In other embodiments, energy damping components 334 and 434 are positioned on the interior surfaces of first and second boards 329 and 429. In one embodiment, the energy damping components 334 and 335 are formed from one or more of expanded polyethylene (EPE) foam, expanded polypropylene (EPP) beaded foam, polyurethane (PU) foam, or other shock absorbing and vibration damping capable materials.

Protective layers 336 and 436 extend across the interior surface of side rails 327 and 328. In one embodiment, the protective layers 336 and 436 are made of felt. In some embodiments, protective layers 336 and 436 extend across the entire interior surface of side rails 327 and 328 respectively. In other embodiments, protective layers 336 and 436 are each split into two sections where the middle portions of side rails 327 and 328 are not covered by protective layers 336 and 436.

The structure is secured using bolts 339, 340, 439, and 440, which are positioned near the corners of the assembly. In one embodiment, the bolts are stainless steel. In another embodiment, the bolts are high-strength aluminum alloy.

Figure 28:
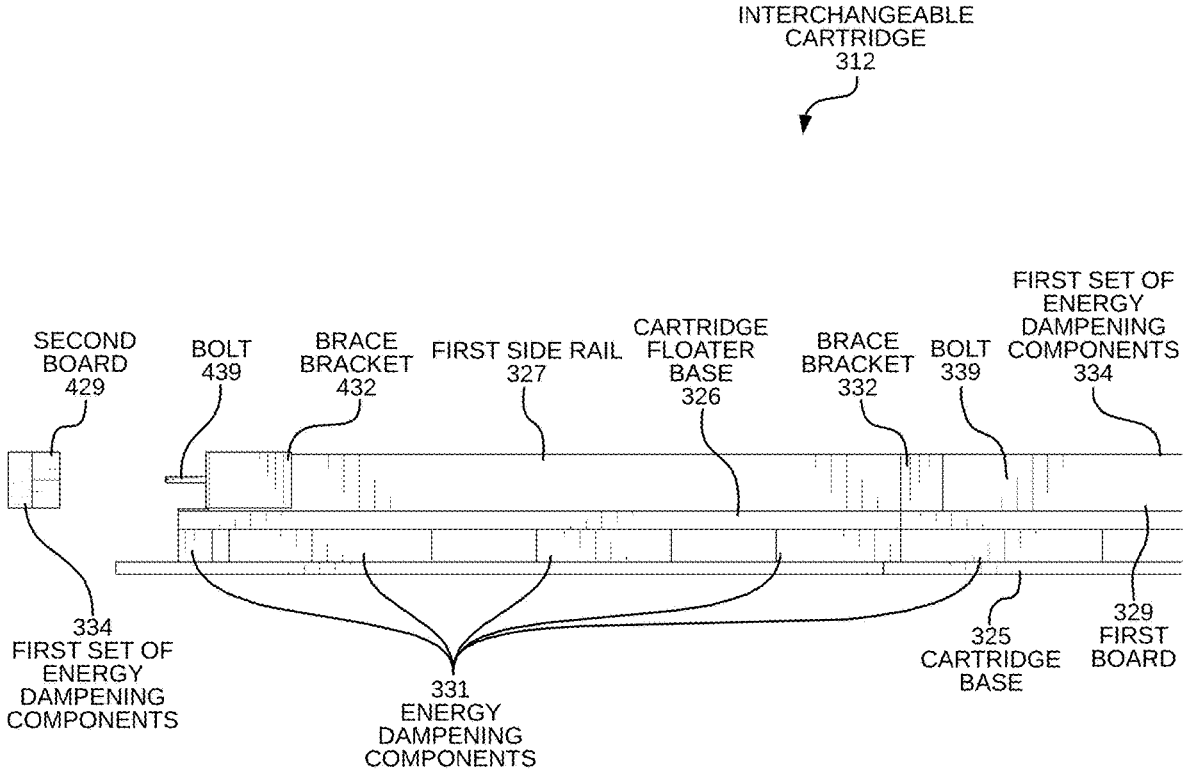
FIG. 28 is a side view diagram of another embodiment of an interchangeable cartridge.

FIG. 28 is a diagram showing a side view of another embodiment of an interchangeable cartridge assembly 312. The cartridge floater base 325 is disposed above energy damping components 331, which are disposed above cartridge base 325. In one embodiment, the cartridge base 325 is formed from wood, engineered wood, or plywood. In another embodiment, cartridge base 325 is made of high-density polyethylene.

A first rail 327 extends along the upper portion of the assembly. In one embodiment, the first rail 327 is made of wood or engineered wood. In another embodiment, the first rail 327 is made of steel or aluminum.

Energy damping components 331 are positioned between cartridge base 325 and cartridge floater base 326. In some embodiments, the energy damping components 331 are made of foam. In one embodiment, the foam is expanded polyethylene (EPE) foam. In another embodiment, the foam is expanded polypropylene (EPP) beaded foam. In yet another embodiment, the foam is polyurethane (PU) foam. In still other embodiments, energy damping components 331 are each made from different shock absorbing and vibration damping materials.

A pair of brace brackets 332 and 432 are shown at each end of first rail 327. A pair of bolts 339 and 439 are each attached to brace brackets 332 and 432. First board 329 is attached to the interchangeable cartridge via bolts 339 and 340. Second board 429 is attached to the interchangeable cartridge via bolts 439 and 440.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. A crate assembly comprising:

a crate having a base; and an interchangeable cartridge, wherein the interchangeable cartridge is supported by the base of the crate, wherein the interchangeable cartridge is insertable and removable from the base of the crate, and wherein the interchangeable cartridge comprises:

a cartridge base;

a cartridge floater base;

a plurality of cartridge side rails;

a cartridge back board;

a cartridge front board, wherein the cartridge floater base, cartridge side rails, cartridge back board, and cartridge front board form a well; and an energy damping component, wherein the energy damping component is disposed between the cartridge base and the cartridge floater base.

2. The crate assembly of claim 1, wherein the energy damping component comprises one or more layers of foam, and wherein the energy damping component is selected to support a load within the crate.

3. The crate assembly of claim 1, further comprising:

a plurality of brace brackets, wherein each brace bracket is affixed to a front end of a cartridge side rail.

4. The crate assembly of claim 3, wherein each of the brace brackets has an end bolt that extends from a front surface of the brace bracket.

5. The crate assembly of claim 4, wherein the cartridge front board is toollessly attachable to the cartridge side rails by sliding openings on the cartridge front board onto end bolts of the brace brackets and securing fasteners over the end bolts such that the cartridge front board is between the fasteners and the cartridge side rails.

6. The crate assembly of claim 1, further comprising:

a plurality of end bolts, wherein each end bolt is affixed to a front end of a cartridge side rail.

7. The crate assembly of claim 1, further comprising:

an additional energy damping component, wherein the additional energy damping component is disposed on an exterior surface of the cartridge front board and is configured to contact a front panel of the crate.

8. The crate assembly of claim 1, further comprising:

an additional energy damping component, wherein the additional energy damping component is disposed on an interior surface of the cartridge back board and is configured to contact a load supported by the interchangeable cartridge.

9. The crate assembly of claim 1, wherein the interchangeable cartridge is configurable to support loads of different weights and dimensions.

10. The crate assembly of claim 1, wherein the interchangeable cartridge is swappable with a new interchangeable cartridge such that the crate is reusable.

11. The crate assembly of claim 1, further comprising:

a plurality of brace brackets, wherein each brace bracket is affixed to a front end or a back end of a cartridge side rail, wherein each of the brace brackets has an end bolt that extends from a front end of the brace bracket, and wherein the cartridge front board or the cartridge back board is toollessly attachable to the cartridge side rails via end bolts of the brace brackets.

12. A method of assembling a crate comprising:

placing an interchangeable cartridge on a base of a server rack crate, wherein the interchangeable cartridge comprises:

a cartridge base;

a cartridge floater base;

a plurality of cartridge side rails;

a cartridge back board;

a cartridge front board, wherein the cartridge floater base, cartridge side rails, cartridge back board, and cartridge front board form a well; and an energy damping component, wherein the energy damping component is disposed between the cartridge base and the cartridge floater base;

placing a load onto the interchangeable cartridge;

enclosing the load with a plurality of panels; and securing the plurality of panels to the base of the server rack crate.

13. The method of claim 12, further comprising:

securing a front panel to a front of the crate.

14. The method of claim 12, wherein the interchangeable cartridge provides shock protection and vibration damping to a server rack placed on the interchangeable cartridge.

15. The method of claim 12, wherein the interchangeable cartridge is configurable to support server racks of different weights and dimensions.

16. The method of claim 12, wherein the load is a server rack that is placed within a well of the interchangeable cartridge.

* * * * *